US008075429B2

(12) United States Patent
Severa et al.

(10) Patent No.: US 8,075,429 B2
(45) **Date of Patent: *Dec. 13, 2011**

(54) RACQUET STRINGING MACHINE

(75) Inventors: William D. Severa, Darien, IL (US); Ronald R. Rocchi, Naperville, IL (US); John B. Lyons, Wilmette, IL (US); Robert T. Kapheim, Elmhurst, IL (US); Erik B. van der Pols, Taichung Hsien (TW)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/758,486

(22) Filed: Apr. 12, 2010

(65) Prior Publication Data

US 2010/0227716 A1 Sep. 9, 2010

Related U.S. Application Data

(63) Continuation-in-part of application No. 12/077,012, filed on Mar. 14, 2008, now Pat. No. 7,695,383.

(60) Provisional application No. 60/922,799, filed on Apr. 11, 2007.

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS

| | | | | |
|---|---|---|---|---|
| 22,740 | A | 1/1903 | You | 473/557 |
| 96,160 | A | 5/1905 | Nakane et al. | 473/557 |
| 2,015,238 | A | 9/1935 | Saladino | 273/73 |
| 2,043,813 | A | 6/1936 | Saladino | 273/73 |
| 2,100,948 | A | 11/1937 | Doll | 273/73 |
| 3,913,912 | A | 10/1975 | Smith | |
| 3,988,022 | A | 10/1976 | Halbrook | 583/647 |
| 4,130,278 | A | 12/1978 | Gutzwiller | 808/538 |
| 4,546,977 | A | 10/1985 | Bosworth, Jr. et al. | 273/73 |
| 4,620,705 | A | 11/1986 | Tsuchida | 273/73 |
| 4,706,955 | A | 11/1987 | Ngadi et al. | 273/73 |
| 5,026,055 | A | 6/1991 | Longeat | 273/73 |
| 5,080,360 | A | 1/1992 | Longeat | 273/73 |
| 5,090,697 | A | 2/1992 | Lee | 273/73 |
| 5,186,505 | A | 2/1993 | Chu | 273/73 |
| 5,269,515 | A | 12/1993 | Chu | 273/73 |
| 5,338,028 | A | 8/1994 | Sung | 273/73 |
| 5,568,921 | A | 10/1996 | Lorentzen et al. | 273/73 |
| 5,590,877 | A | 1/1997 | Ho | 473/556 |

(Continued)

FOREIGN PATENT DOCUMENTS

DE 29 15 647 A1 10/1980

(Continued)

*Primary Examiner* — Raleigh W. Chiu

(74) *Attorney, Agent, or Firm* — Terence P. O'Brien

(57) ABSTRACT

A stringing machine includes a base and an adjustable stringing platform coupled to the base. The stringing platform includes a turntable rotatable about a first axis, and a first releasable resistance assembly coupled to the turntable. The first releasable resistance assembly is selectable between an engaged operating mode in which the releasable resistance assembly resists rotation of the turntable about the first axis, and a disengaged operating mode in which the releasable resistance assembly does not resist rotation of the turntable about the first axis. The releasable resistance assembly includes a magnetorheological fluid for resisting rotation of the turntable about the first axis when in the engaged operating mode.

22 Claims, 20 Drawing Sheets

U.S. PATENT DOCUMENTS

| | | | | |
|---|---|---|---|---|
| 5,639,086 | A | 6/1997 | Wolverton et al. | 473/555 |
| 5,733,212 | A | 3/1998 | Wise et al. | 473/557 |
| 5,820,500 | A | 10/1998 | Raos | 473/557 |
| 5,908,362 | A | 6/1999 | Carr | 473/557 |
| 6,162,139 | A | 12/2000 | Bassili | 473/557 |
| 6,227,990 | B1 | 5/2001 | Wise et al. | 473/557 |
| 6,398,674 | B2 | 6/2002 | Tsuchida | 473/557 |
| 6,712,723 | B2 | 3/2004 | You | 473/555 |
| 6,764,418 | B1 | 7/2004 | Lee | 473/557 |
| 6,837,811 | B1 | 1/2005 | Wu | 473/557 |
| 7,695,383 | B2 * | 4/2010 | Severa et al. | 473/557 |
| 2007/0149079 | A1 * | 6/2007 | Vito et al. | 442/181 |
| 2008/0214337 | A1 | 9/2008 | Tsuchida | 473/555 |

FOREIGN PATENT DOCUMENTS

| | | | |
|---|---|---|---|
| EP | 0136245 | A2 | 4/1985 |
| EP | 1980298 | | 10/2008 |
| WO | WO 95/29740 | | 11/1995 |
| WO | W02009117827 | | 10/2009 |
| WO | W02009152386 | | 12/2009 |

* cited by examiner

RACQUET STRINGING MACHINE

RELATED U.S. APPLICATION DATA

The present application is a continuation-in-part application of U.S. patent application Ser. No. 12/077,012, entitled "Racquet Stringing Machine," filed on Mar. 14, 2008 now U.S. Pat. No. 7,695,383, which claims priority to U.S. Provisional Application Ser. No. 60/922,799 filed on Apr. 11, 2007.

FIELD OF THE INVENTION

The present invention relates to a machine for stringing racquets. This stringing machine has enhanced ergonomic features.

BACKGROUND OF THE INVENTION

The act of stringing a racquet requires a considerable amount of manual labor. Stringing machines assist in the process by maintaining the racquet in place and providing desired tension in the strings, but a majority of the work involved is performed by a person. More particularly, a person must align the racquet within the stringing machine, and then string each of the cross or main strings individually, followed by weaving each of the cross and main strings to form the resulting string grid.

Those in the racquet stringing business often spend many hours a day standing in front of a stringing machine. Conventional stringing machines include a stringing platform with a turntable positioned on top of a fixed stand. The turntable spins within a plane parallel to the floor. Because of the fixed orientation of the stand and the planar position of the turntable, the person stringing the racquet must adjust his or her posture to conform to the position of the stringing machine. In particular, one of the racquet stringer's shoulders is often positioned much higher than the other. Also, the fixed orientation of the stringing machine often induces the racquet stringer to hunch over the turntable. The awkward posture induced by conventional stringing machines often causes injuries and fatigue, which ultimately lead to reduced efficiency in the performance of the racquet stringer. Additionally, conventional stringing machines typically include a vertical stand on a base. The stand and/or base can interfere with the placement of the stringer's feet and/or legs, leading to additional awkwardness in the stringer's posture.

During the stringing process, the racquet is clamped to the stringing platform and the turntable allows the racquet stringer to manually spin the racquet to adjust the positioning of the racquet with respect to the various steps of the stringing process. Turntables on conventional stringing machines are generally free to spin in response to any applied tangential force unless or until a brake is applied, with the brake preventing any further spinning. If the stringing platform were positioned in the stringing machine such that the turntable spins in a plane non-parallel with the floor, namely tilted toward the racquet stringer, the handle of any racquet clamped to the stringing platform would be drawn by gravity to the lowest point within the plane. Consequently, even though the positioning of the angled or tilted turntable may be more comfortable for the user, the need to either continually move the racquet back into its intended position or continually lock and unlock the brake on the turntable in order to overcome the effects of gravity on the clamped-on racquet would be a nuisance.

It would thus be desirable to provide a stringing machine that is ergonomically designed to allow users to work with the stringing machine without having to assume awkward or uncomfortable positions, and without having to continuously manually override effects of gravity on the turntable.

SUMMARY OF THE INVENTION

The present invention presents an ergonomically-designed racquet stringing machine for stringing of a racquet by a user. The stringing machine includes a base configured for supporting the stringing machine on a generally horizontal surface, a stand having upper and lower end regions, the lower end region of the stand upwardly extending from a first location of the base, an adjustable stringing platform coupled at a second location to the upper end region of the stand, and a string tensioning assembly coupled to the stand.

The "first location" of the base may be defined as the center of the footprint resulting from the attachment of the stand to the base. Similarly, the "second location" may be defined as the center of the footprint resulting from the attachment of the stringing platform to the stand. The "footprint" is a two-dimensional representation of the intersection of two parts that depicts the area of that intersection. The first and second locations define a line that is angled by a predetermined angle from horizontal.

In one embodiment, the stand extends from the base at an angle between about 70 and about 89 degrees from a horizontal plane (1 and 20 degrees from a vertical plane). Alternatively, the angle between the stand and the base may be between about 80 and about 85 degrees from a horizontal plane (5 and 10 degrees from a vertical plane), for example 83 degrees from a horizontal plane (7 degrees from a vertical plane). This angled orientation of the stand provides ample legroom for the user standing in front of the stringing machine. Additionally, a forward side of the base intended to face the user may define a recessed area for accommodating at least a portion of the user's feet thereby enabling the user to stand closer to the racquet during stringing.

The angle between the base and the stand may be adjustable. For instance, a stand adjustment assembly capable of adjusting the angle of the line defined by the first and second locations may be coupled to the base and the stand. The stand adjustment assembly may be configured to adjust the angle of the line within a range of 0.1 to 15.0 degrees.

In another embodiment, the adjustable stringing platform may include a turntable rotatable about a first axis, and a first releasable resistance assembly, such as a grease brake, coupled to the turntable. The first releasable resistance assembly may be positionable between an engaged operating position in which the resistance assembly resists rotation of the turntable about the first axis, and a disengaged operating position in which the resistance assembly does not resist rotation of the turntable about the first axis.

The first releasable resistance assembly can provide resistance to unintentional rotation of the turntable. In particular, the first releasable resistance assembly can negate the effects of gravity when a racquet is in place and the stringing platform is tilted, such as may be caused by the tilted angle of the stand. For example, the first releasable resistance assembly may provide a resistance against rotation of the turntable (resistance against a torque) about the first axis of within the range of 0.1 to 36 in-lbf, or more preferably within the range of 0.1 to 12.0 in-lbf.

The first releasable resistance assembly suitably includes a high viscosity fluid, such as a grease, for resisting rotation of the turntable when in the engaged operating position. The high viscosity fluid may have a viscosity range of 1 to 500 centipoise (cP), for example. In certain embodiments, the first releasable resistance assembly includes first and second members contacting the high viscosity fluid, with at least one of the first and second members being rotatable about the first axis. The first and/or second members may include a plurality of projections, such as spaced-apart concentric rings, contacting the fluid. For example, each of the first and second members may include a plurality of spaced-apart concentric rings with the rings of the first and second portions configured to correspond to each other such that portions of the rings of one of the members fit within the spaces between the rings of the other member. The first releasable resistance assembly may also include a latch that releasably engages the first member to prevent the first member from rotating about the first axis.

A second releasable resistance assembly, separate from the first releasable resistance assembly, may also be coupled to the stringing platform. For example, the turntable may include a ring centered about the first axis, and the second releasable resistance assembly may be configured to releasably engage the ring to prevent rotation of the turntable about the first axis.

The present invention provides a stringing machine includes a base and an adjustable stringing platform coupled to the base. The stringing platform includes a turntable rotatable about a first axis, and a first releasable resistance assembly coupled to the turntable. The first releasable resistance assembly is selectable between an engaged operating mode in which the releasable resistance assembly resists rotation of the turntable about the first axis, and a disengaged operating mode in which the releasable resistance assembly does not resist rotation of the turntable about the first axis. The releasable resistance assembly includes a magnetorheological fluid for resisting rotation of the turntable about the first axis when in the engaged operating mode.

According to a principal aspect of a preferred form of the invention, a stringing machine is configured to support a racquet. The stringing machine includes a base and an adjustable stringing platform coupled to the base. The stringing platform includes a turntable rotatable about a first axis, and a first releasable resistance assembly coupled to the turntable. The turntable includes a ring centered about the first axis. The first releasable resistance assembly is selectable between an engaged operating mode in which the releasable resistance assembly applies a resistance force of 3 lbs or less against the rotation of the turntable about the first axis, and a disengaged operating mode in which the releasable resistance assembly does not resist rotation of the turntable about the first axis. The first releasable resistance assembly includes a pair of brake arms configured to selectably engage the ring for resisting rotation of the turntable about the first axis when in the engaged operating mode.

According to another principal aspect of a preferred form of the invention, a stringing machine is configured to support a racquet. The stringing machine includes a base and a stringing platform coupled to the base. The stringing platform includes a a turntable rotatable about a first axis, a first releasable resistance assembly coupled to the turntable, and a second releasable resistance assembly coupled to the stringing platform and the turntable. The first releasable resistance assembly is selectable between an engaged operating mode in which the releasable resistance assembly applies a resistance force of 3 lbs or less against the rotation of the turntable about the first axis, and a disengaged operating mode in which the releasable resistance assembly does not resist rotation of the turntable about the first axis. The second releasable resistance assembly when activated locks the turntable preventing the turntable from rotating about the first axis.

Any one or more of the stringing machine embodiments described herein may be applied to machines for stringing tennis racquets, racquetball racquets, squash racquets, badminton racquets, and any other strung racquet. Regardless of the type of racquet, compatibility of the stringing machine with the user is greatly improved by using any of the stringing machine enhancements in this invention.

This invention will become more fully understood from the following detailed description, taken in conjunction with the accompanying drawings described herein below, and wherein like reference numerals refer to like parts.

DETAILED DESCRIPTION OF THE INVENTION

Figure 1:
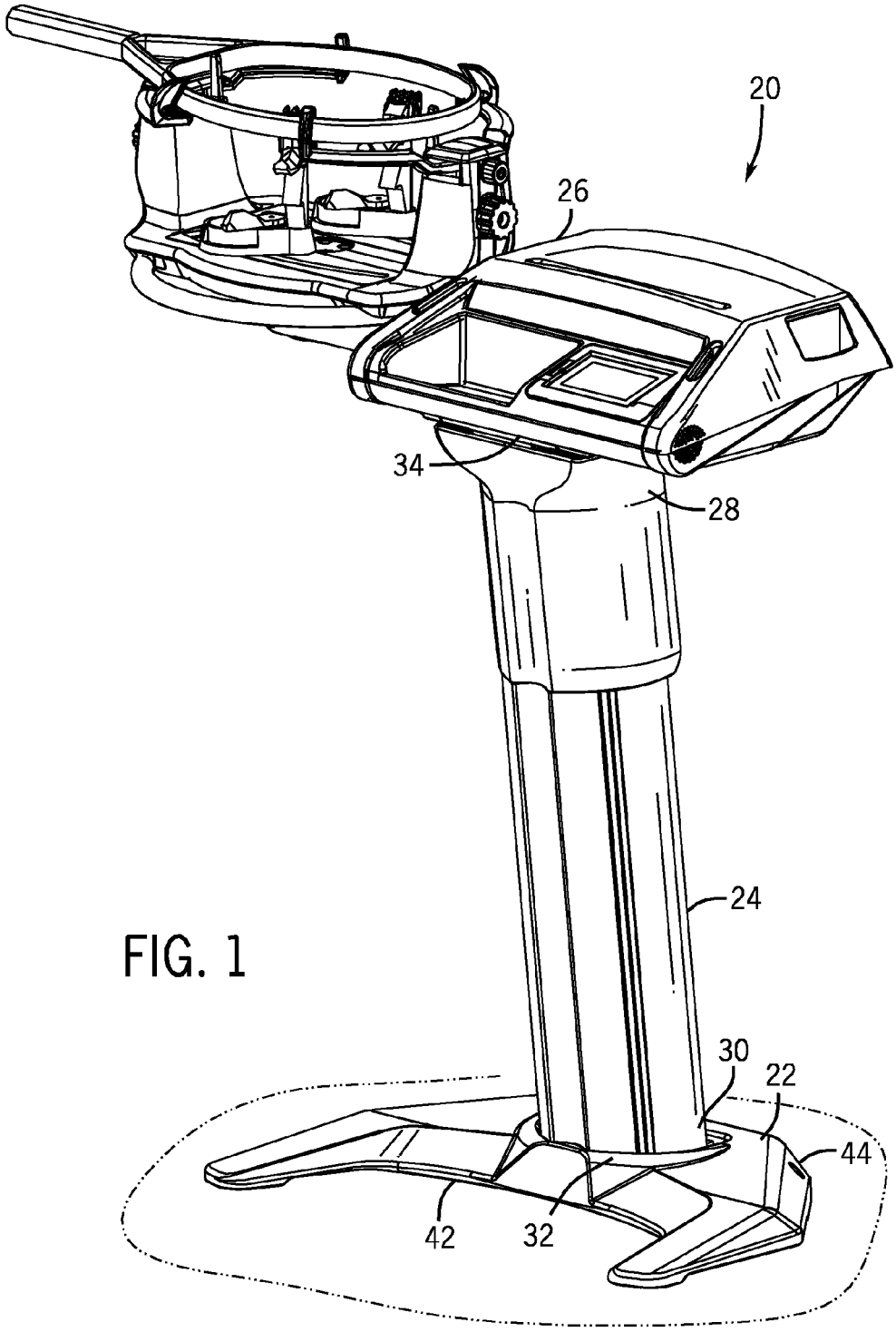
FIG. 1 is a perspective view of a racquet stringing machine.
Figure 2:
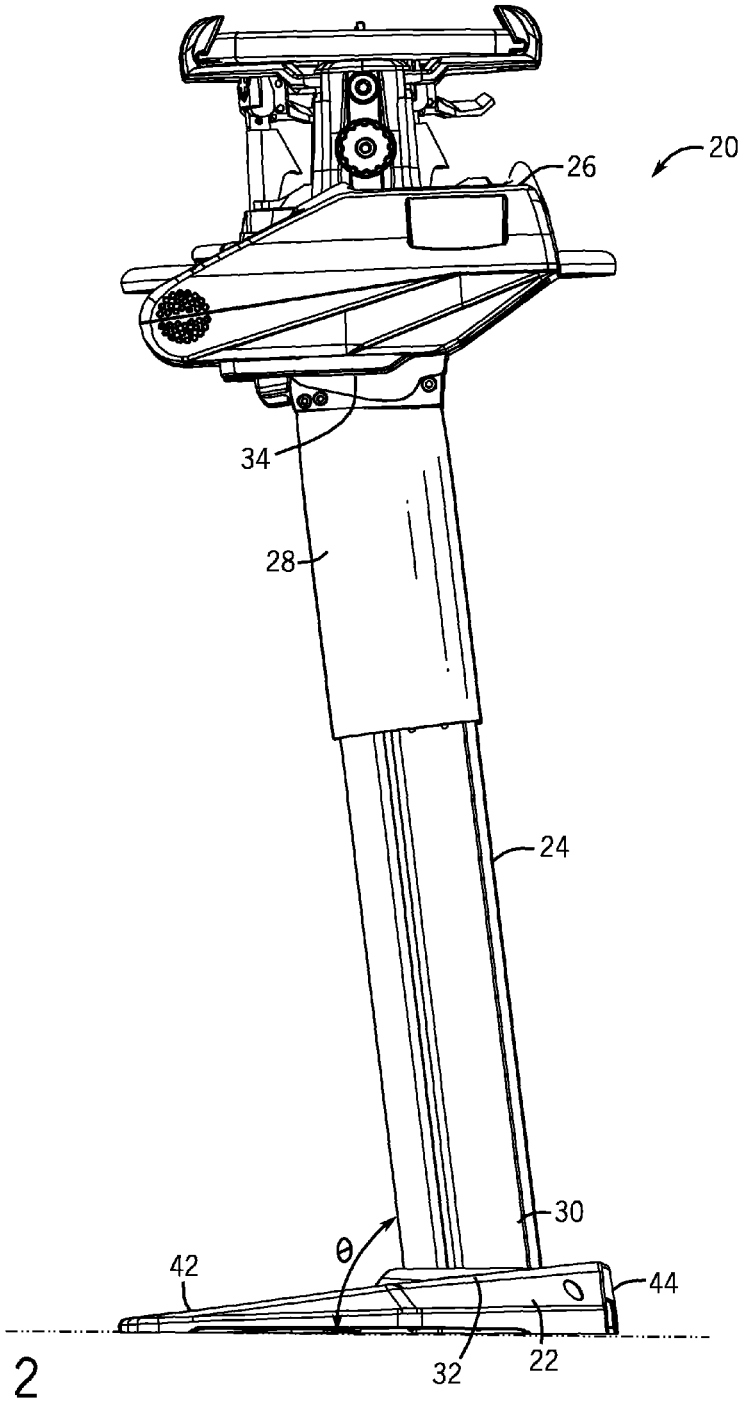
FIG. 2 is a side view of a racquet stringing machine.

Referring to FIGS. 1 and 2, an ergonomically-designed racquet stringing machine is indicated generally at 20. The ergonomic features of the stringing machine 20 are intended to provide enhanced comfort for a user during the process of stringing a racquet.

Figure 3:
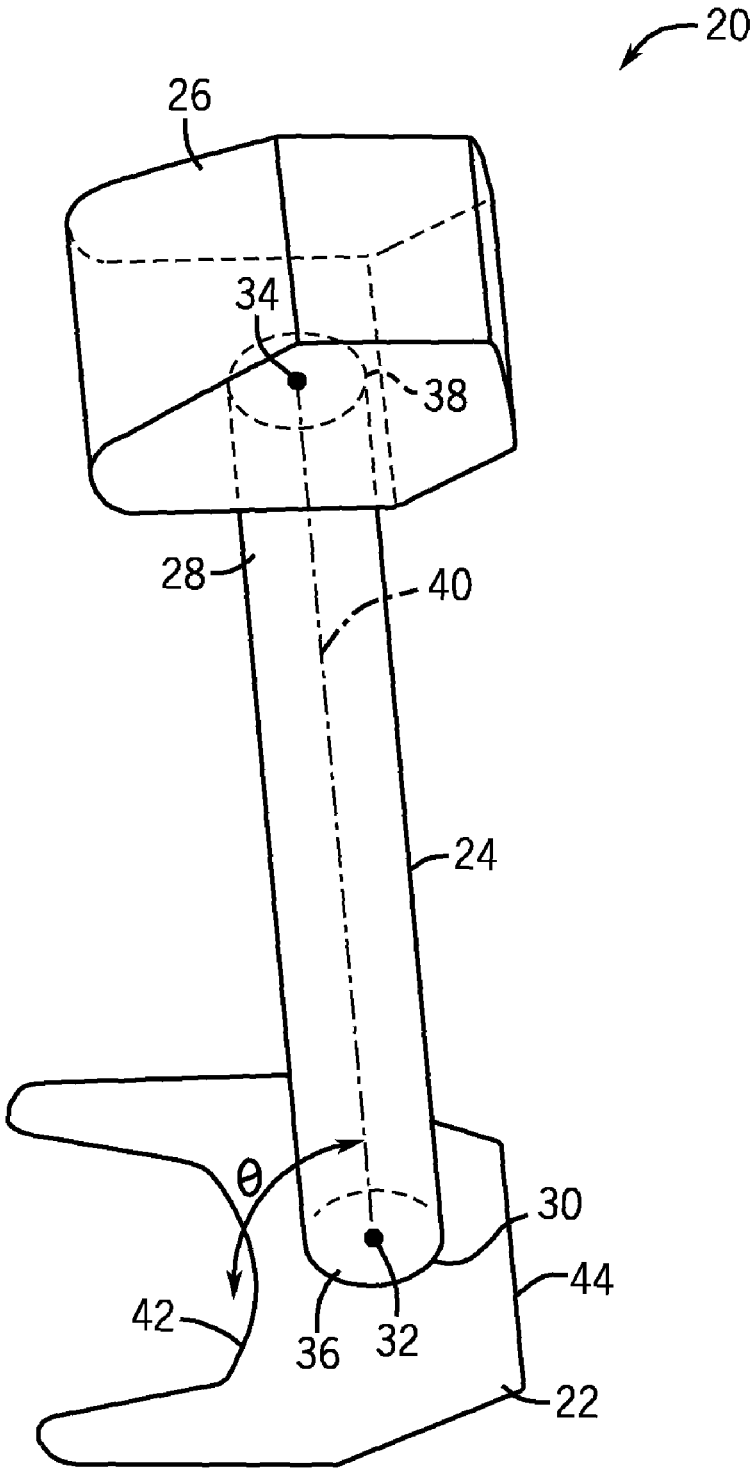
FIG. 3 is a schematic view of a racquet stringing machine.

The stringing machine 20 includes a base 22 configured for supporting the stringing machine 20 on a generally horizontal surface, and a stand 24 having an upper end region 28 and a lower end region 30. The lower end region 30 of the stand 24 extends upwardly from a first location 32 on the base 22, and an adjustable stringing platform 26 is coupled to the upper end region 28 of the stand 24 at a second location 34 on the stringing platform 26, as shown in FIG. 3.

The "first location" 32 on the base 22 may be defined as the center of the footprint 36 resulting from the attachment of the stand 24 to the base 22. Similarly, the "second location" 34 may be defined as the center of the footprint 38 resulting from the attachment of the stringing platform 26 to the stand 24. The "footprint" is a two-dimensional representation of the intersection of two parts that depicts the area of that intersection. The first and second locations 32, 34 define a line 40 that is angled by a predetermined angle (θ) from horizontal. It is this line 40 to which we refer when discussing the angle θ between the stand 24 and the base 22. The stand 24 itself may be curved, such as a "C" shape, or may appear to be bent at one or more locations along its length, but in any case, if the line 40 connecting the first location 32 and the second location 34 defines an angle θ from horizontal within the range defined herein, the stringing machine 20 is still considered to fall within the scope of this invention.

In certain embodiments, the stand 24 extends from the base 22 at an angle θ between about 70 and about 89 degrees from a horizontal plane (1 and 20 degrees from a vertical plane), in a direction generally toward the user. Alternatively, the angle θ between the stand 24 and the base 22 may be between about 80 and about 85 degrees from a horizontal plane (5 and 10 degrees from a vertical plane), for example 83 degrees from a horizontal plane (7 degrees from a vertical plane). In contrast, conventional stringing machines are configured with a stand that extends perpendicularly from a base. The angled orientation of the stand 24 described in the present invention provides ample legroom for the user standing in front of the stringing machine 20. More particularly, by tilting the stand 24 at an angle θ non-perpendicular to the base 22, more legroom can be created for the user, thereby allowing the user to stand closer to the stringing machine 20. For example, a 7-degree tilt, such that the angle θ is 83 degrees from a horizontal plane, provides 40-50% more legroom compared to a stand 24 that is perpendicular to the base 22.

Additionally, the base 22 may be configured to provide a comfortable standing area for the user. The base 22 includes a forward side 42 intended to face the user and a rear side 44 opposite the forward side 42. As illustrated in FIGS. 1-3, the forward side 42 of the base 22 may define a recessed area for accommodating at least a portion of the user's feet, thereby enabling the user to stand closer to the racquet during the stringing process.

Figure 5:
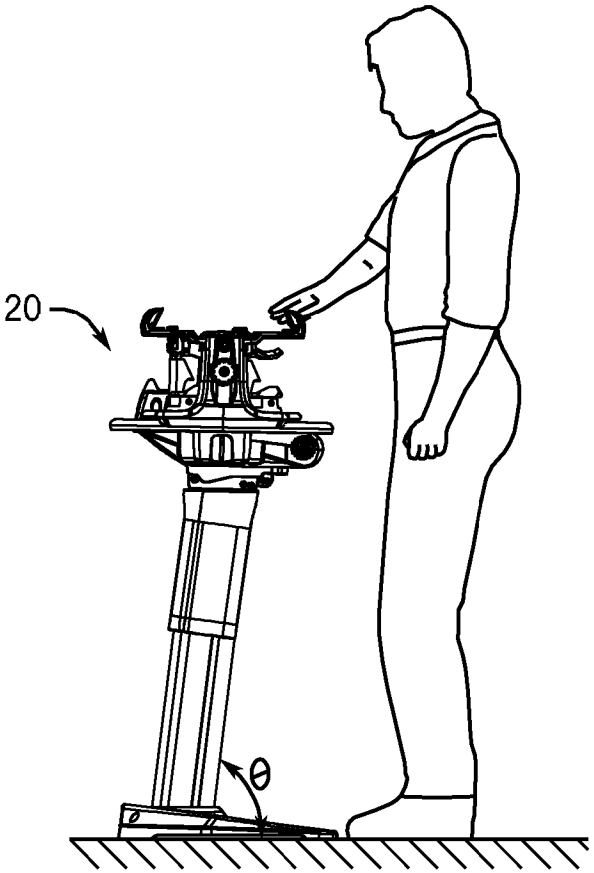
FIG. 5 is a side view of a user in a preferred posture while clamping a racquet on a racquet stringing machine.
Figure 4:
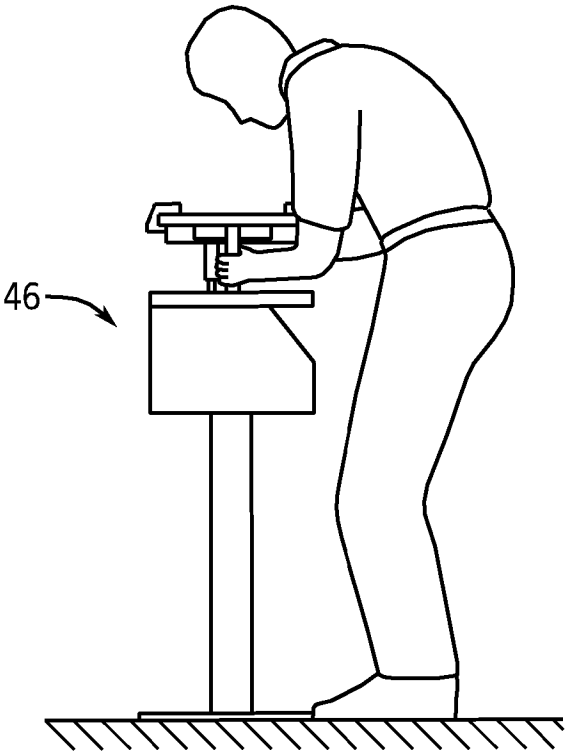
FIG. 4 is a side view of a user in an induced posture while clamping a racquet on a racquet stringing machine.

When stringing a racquet, the racquet must first be clamped onto the adjustable stringing platform 26. As illustrated in FIG. 4, conventional stringing machines 46 induce poor posture for many users trying to clamp the racquet onto the stringing platform. By configuring the stand 24 to extend at a non-perpendicular angle θ between the base 22 and the stand 24 and increasing the height of the stand 24, the user in the desired operating position can stand closer to the stringing platform 26, thereby preventing the user from hunching over the stringing platform 26, as shown in FIG. 5. The height of the stand 24 may either be fixed or adjustable. Any suitable height-adjusting mechanism can be applied to the stringing machine 20, such as a telescoping height-adjustment mechanism.

Figure 7:
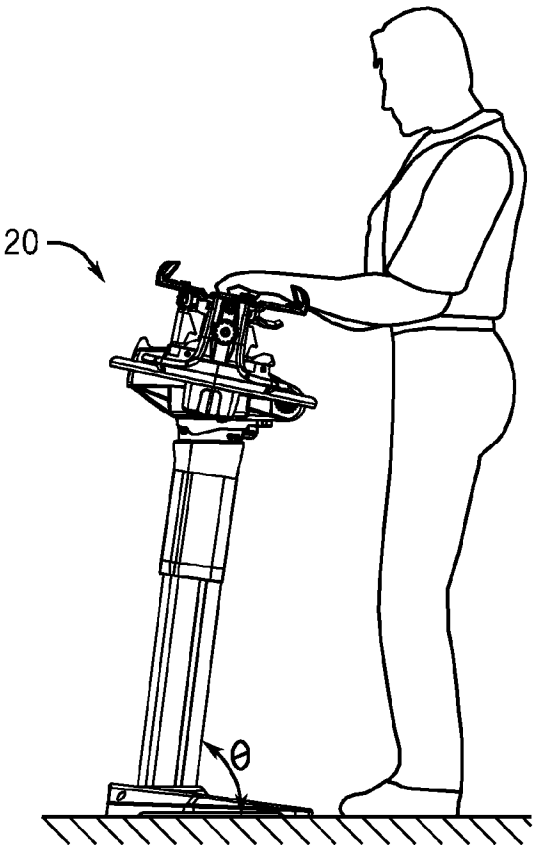
FIG. 7 is a side view of a user in a preferred posture while stringing main strings on a racquet.
Figure 6:
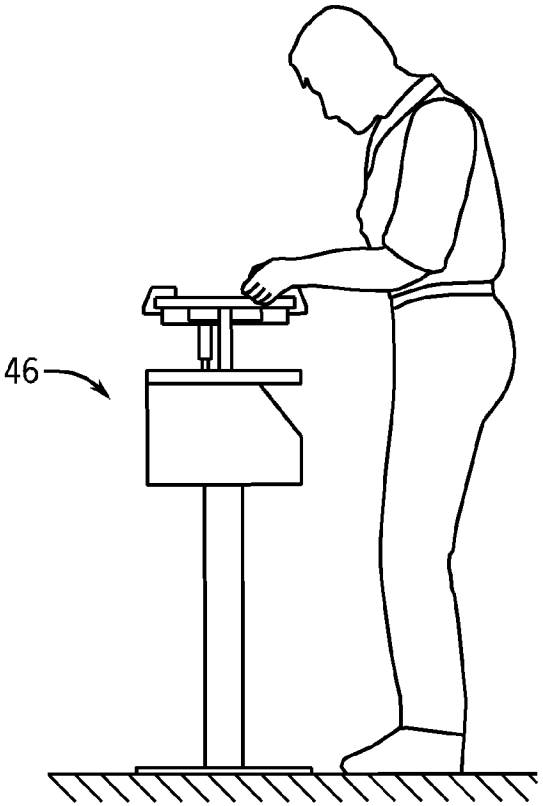
FIG. 6 is a side view of a user in an induced posture while stringing main strings on a racquet.

Additional steps in the stringing process also induce poor posture for many users. As shown in FIG. 6, the process of stringing the main strings may cause neck strain or other discomfort due to the positioning of the stringing platform with respect to the user's position. Once again, by configuring the stand 24 to extend at a non-perpendicular angle θ between the base 22 and the stand 24 and increasing the height of the stand 24, the positioning of the stringing platform 26 suitably provides a comfortable working area for the user in which the user, in the desired operating position, is able to stand upright in a relatively comfortable position, as shown in FIG. 7.

Figure 9:
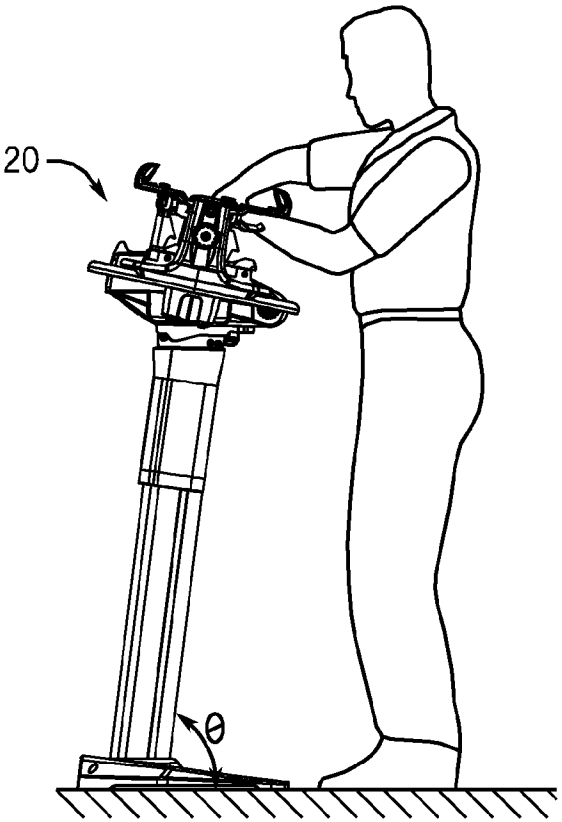
FIG. 9 is a side view of a user in a preferred posture while weaving cross strings on a racquet.
Figure 8:
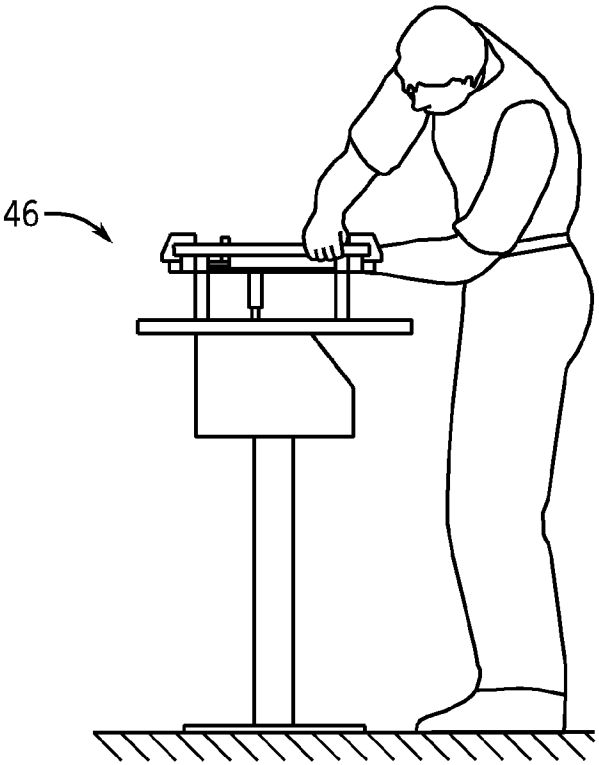
FIG. 8 is a side view of a user in an induced posture while weaving cross strings on a racquet.

Similarly, the detail-oriented process of weaving cross strings may also cause neck strain or other discomfort, as exemplified in FIG. 8. By configuring the stand 24 to extend at a non-perpendicular angle θ between the base 22 and the stand 24, the height and angle of the stringing platform 26 can be arranged in a position that allows the user to weave the cross strings in a more ergonomically preferable operating position, as shown in FIG. 9.

Figure 10:
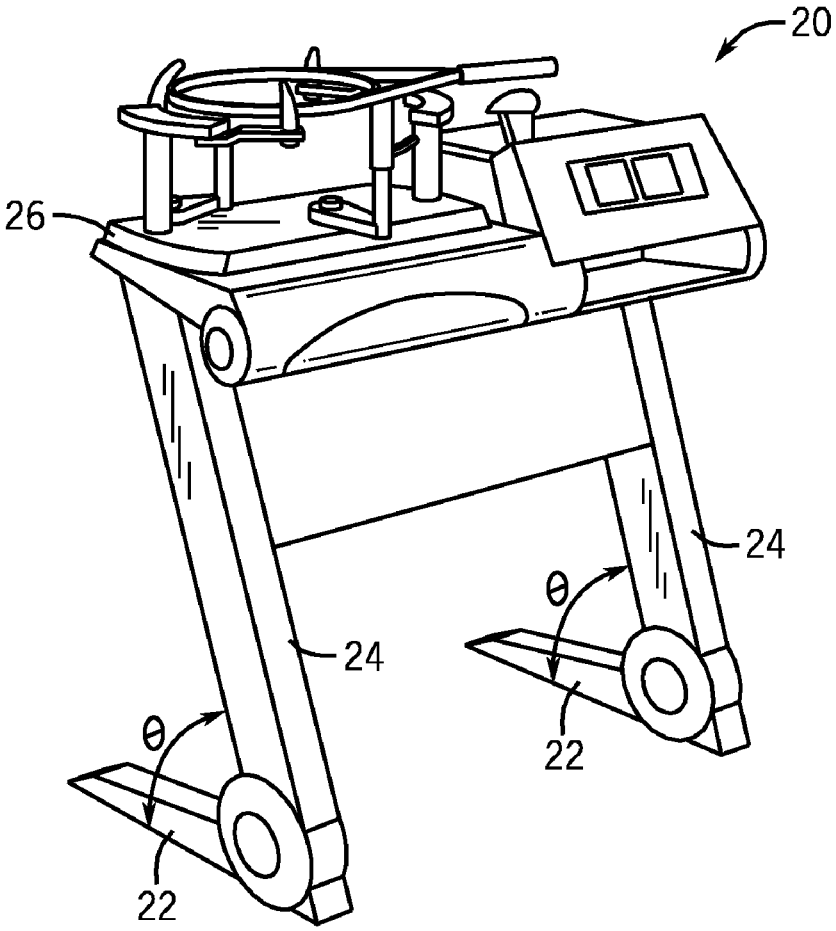
FIG. 10 is another perspective view of a racquet stringing machine.

The base 22 and stand 24 may be a single-leg design, as illustrated in FIGS. 1 and 2. Alternatively, a two-leg design, as illustrated in FIG. 10, may work equally well. In any case, the base 22 may be die-cast for added stability. The major components of the stringing machine 20, namely the base 22, stand 24, and stringing platform 26, may be formed of metal, wood, plastic, high-strength polymers, composite materials, or any combination of these materials, for example.

In certain embodiments, the angle θ between the base 22 and the stand 24 may be permanently fixed, or non-adjustable. In other embodiments, however, the angle θ between the base 22 and the stand 24 may be adjustable. For instance, a stand adjustment assembly capable of adjusting the angle θ of the line 40 defined by the first and second locations 32, 34 may be coupled to the base 22 and the stand 24. The stand adjustment assembly may be configured to adjust the angle θ of the line 40 within a range of 0.1 to 15.0 degrees.

The angular adjustment between the base 22 and the stand 24 may be performed either manually or automatically. For example, the stand adjustment assembly may include a drive mechanism formed by a chain that runs in a track. The drive mechanism may be controlled electronically, for example. Those skilled in the art are familiar with a variety of suitable drive mechanisms that would be appropriate for adjusting the angle θ between the base 22 and the stand 24. Therefore, the details of such mechanisms will not be described in detail herein.

Figure 11:
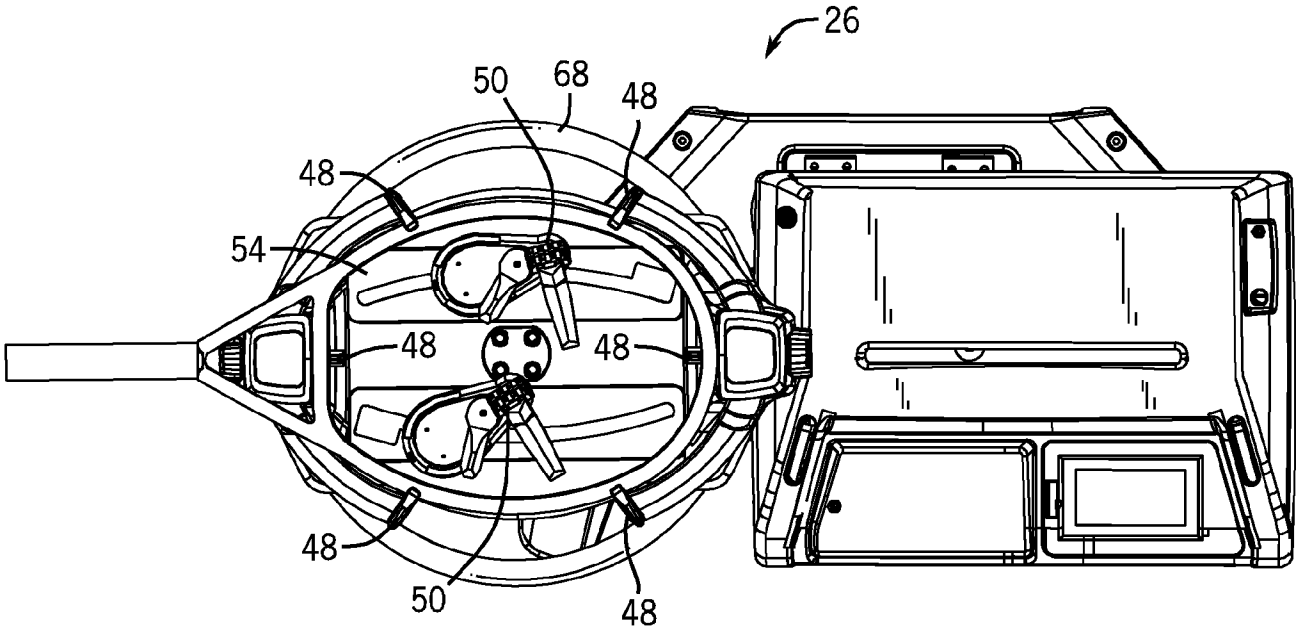
FIG. 11 is a top view of a stringing platform on a racquet stringing machine.
Figure 12:
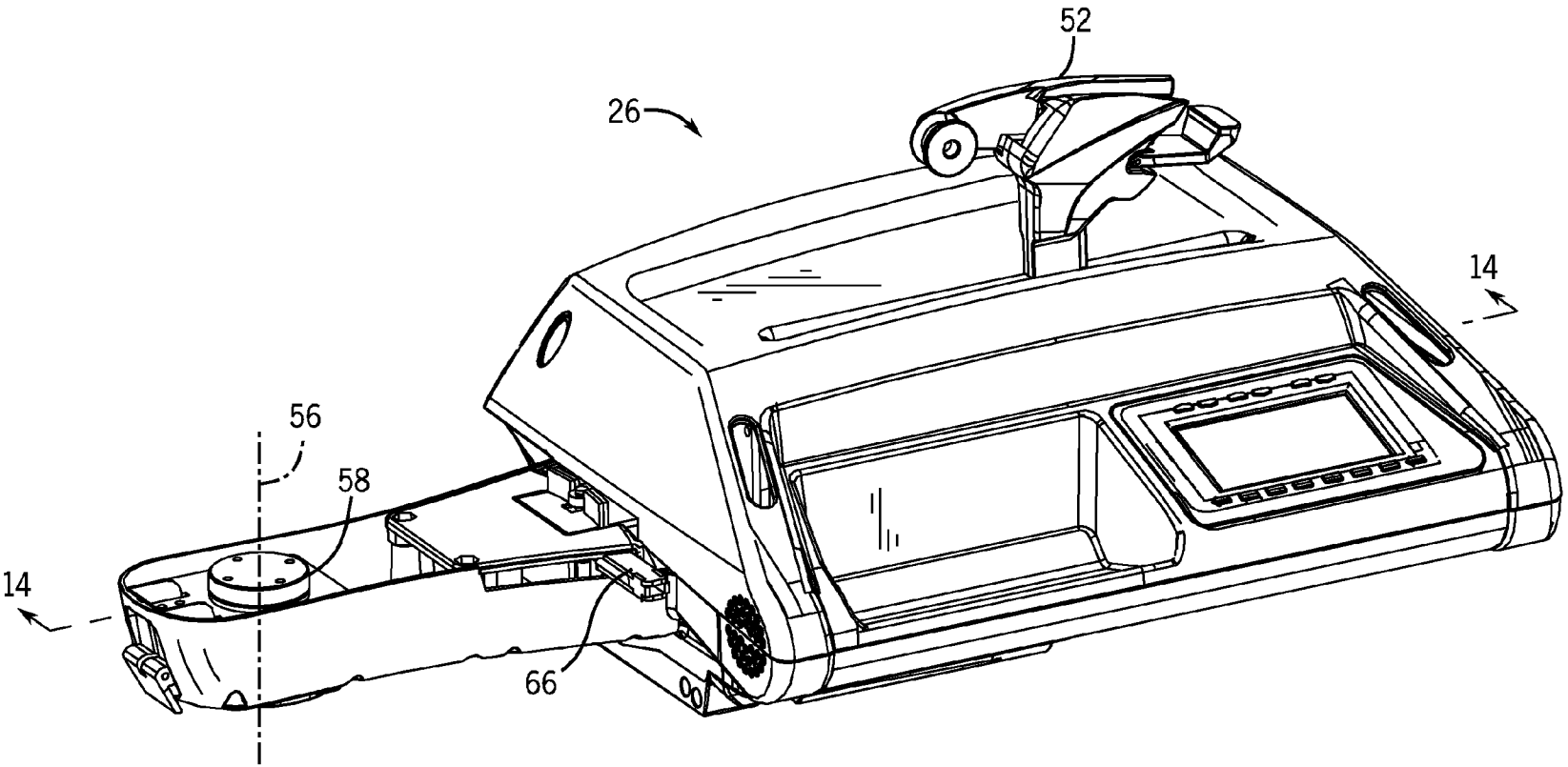
FIG. 12 is a perspective view of a stringing platform.

As illustrated in FIG. 11, the stringing platform 26 includes multiple frame clamps 48 for maintaining the frame of a racquet in place on the stringing platform 26, and two string clamps 50 for maintaining the strings in place during the stringing process. Referring to FIG. 2, the stringing platform 26 and the frame clamps 48 support the racquet about a stringing plane. Referring to FIGS. 7 and 9, the stringing platform 26 can support the racquet such that the stringing plane of the racquet is angled with respect to a generally horizontal support surface. As shown in FIG. 12, a string tensioning assembly 52 is coupled to the stand 24 atop the stringing platform 26. The string tensioning assembly 52 pulls the strings to the desired tension during the stringing process. The stringing platform 26 may either be configured as shown in FIGS. 11 and 12 or, alternatively, may be a conventional stringing platform as found on conventional stringing machines.

Figure 13:
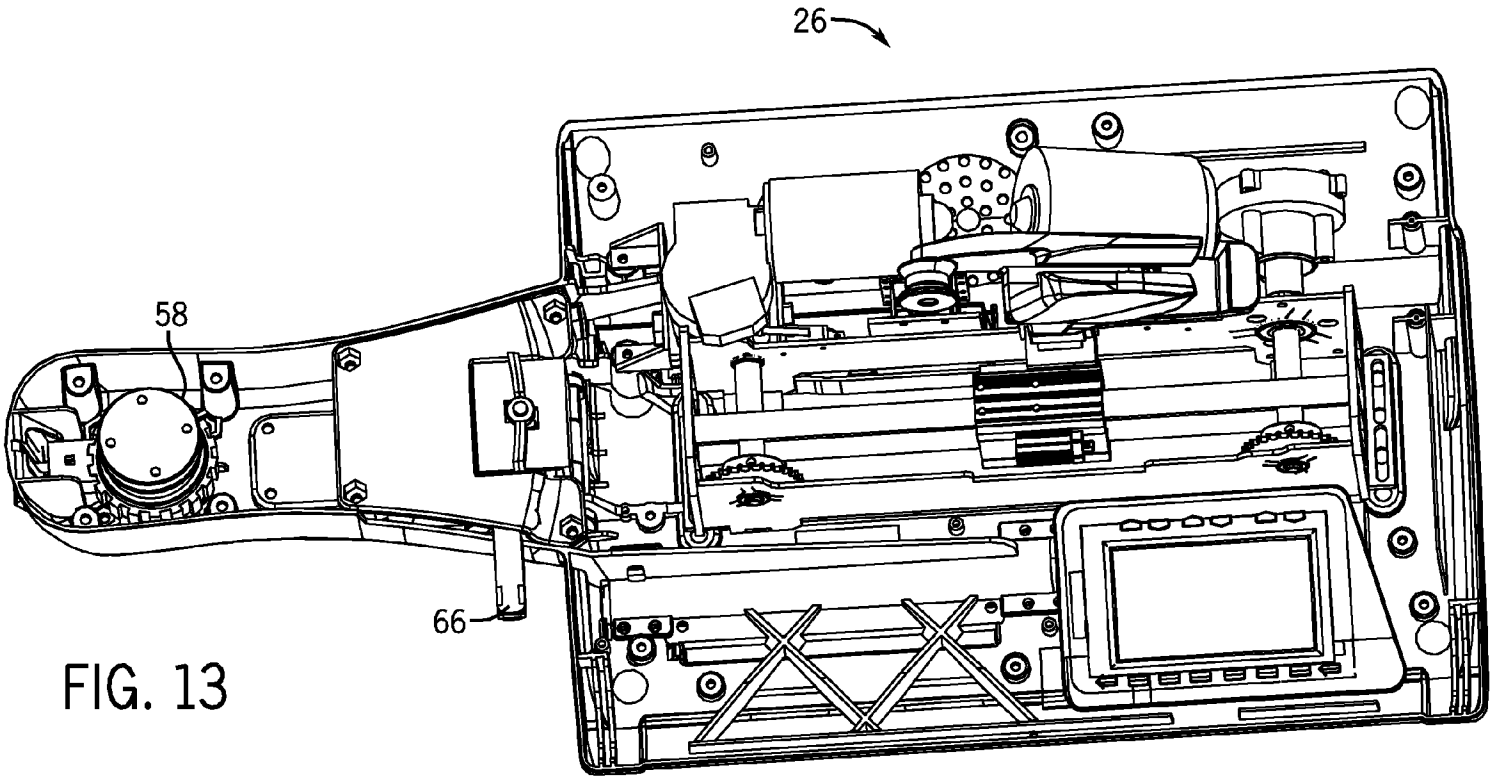
FIG. 13 is an interior view of a stringing platform.

In certain embodiments, the stringing platform 26 may include a turntable 54 rotatable about a first axis 56, and a first releasable resistance assembly 58, such as a grease brake, coupled to the turntable 54, as shown in FIGS. 11-13. The turntable 54 allows the racquet to spin in a plane in which the frame of the racquet lies. The first releasable resistance assembly 58 may be positionable between an engaged operating position in which the resistance assembly 58 resists rotation of the turntable 54 about the first axis 56, and a disengaged operating position in which the resistance assembly 58 does not resist rotation of the turntable 54 about the first axis 56.

The first releasable resistance assembly 58 can provide resistance to unintentional rotation of the turntable 54. In particular, the first releasable resistance assembly 58 can negate the effects of gravity when a racquet is in place and the stringing platform 26 is tilted, such as may be caused by the tilted angle of the stand 24. For example, the first releasable resistance assembly may provide a resistance against rotation of the turntable (resistance against a torque) about the first axis of within the range of 0.1 to 36 in-lbf, or more preferably within the range of 0.1 to 12.0 in-lbf.

The first releasable resistance assembly 58 suitably includes a high viscosity fluid, such as a grease, for resisting rotation of the turntable 54 when in the engaged operating position. The high viscosity fluid may have a viscosity range of 1 to 500 cP, for example. By using such a highly viscous lubricant, the turntable 54 can be maintained in place, even when the turntable 54 is lying in a plane non-parallel to the horizontal surface on which the stringing machine 20 is standing, without the need to mechanically lock the turntable 54 in place.

Figure 14:
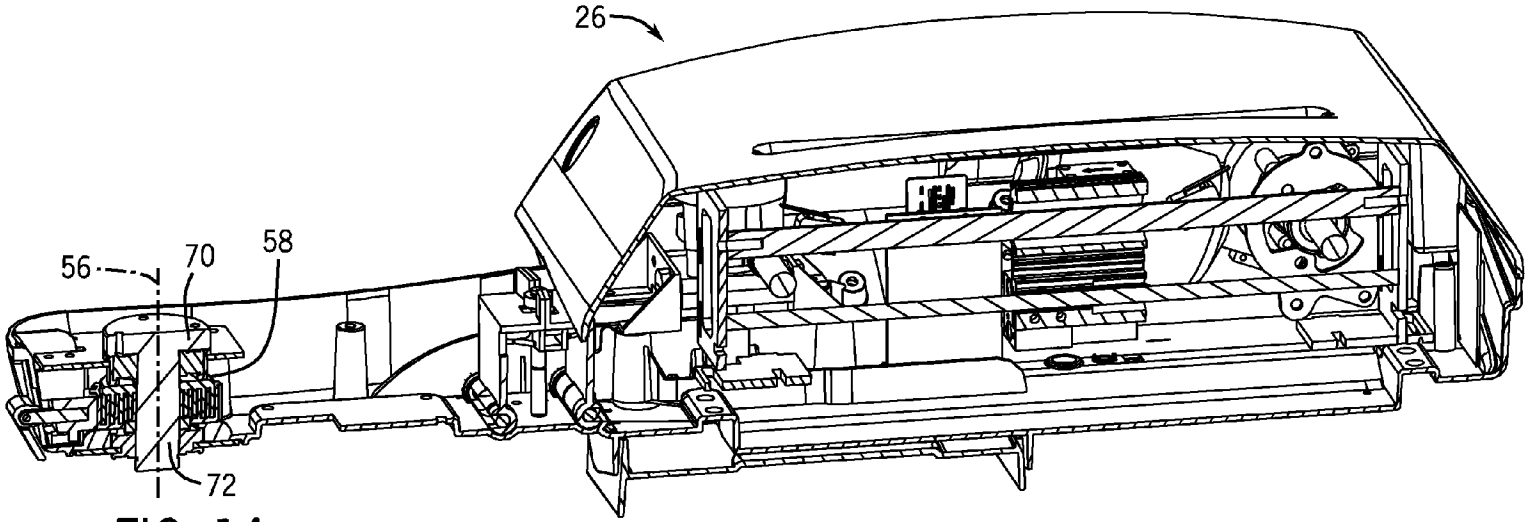
FIG. 14 is a cross-sectional view of the stringing platform of FIG. 12, taken along line 14-14.
Figure 15:
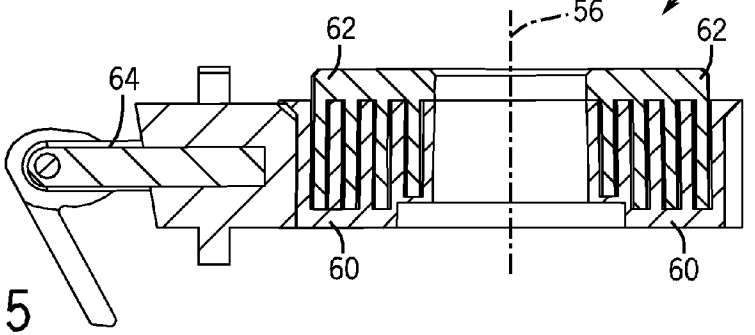
FIG. 15 is a cross-sectional view of a releasable resistance assembly.
Figure 16:
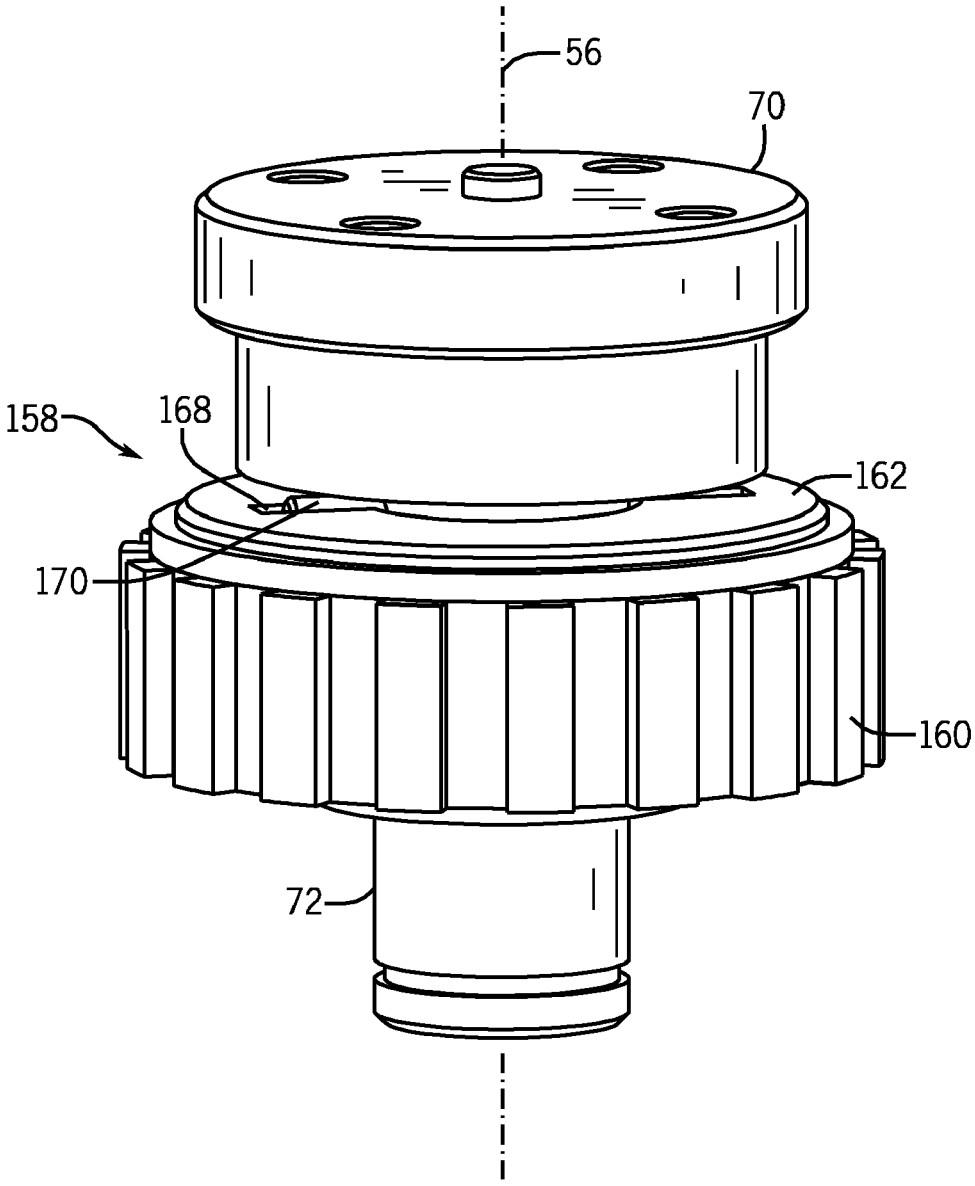
FIG. 16 is a front perspective view of a first releasable resistance assembly in accordance with an alternative preferred embodiment of the present invention.
Figure 17:
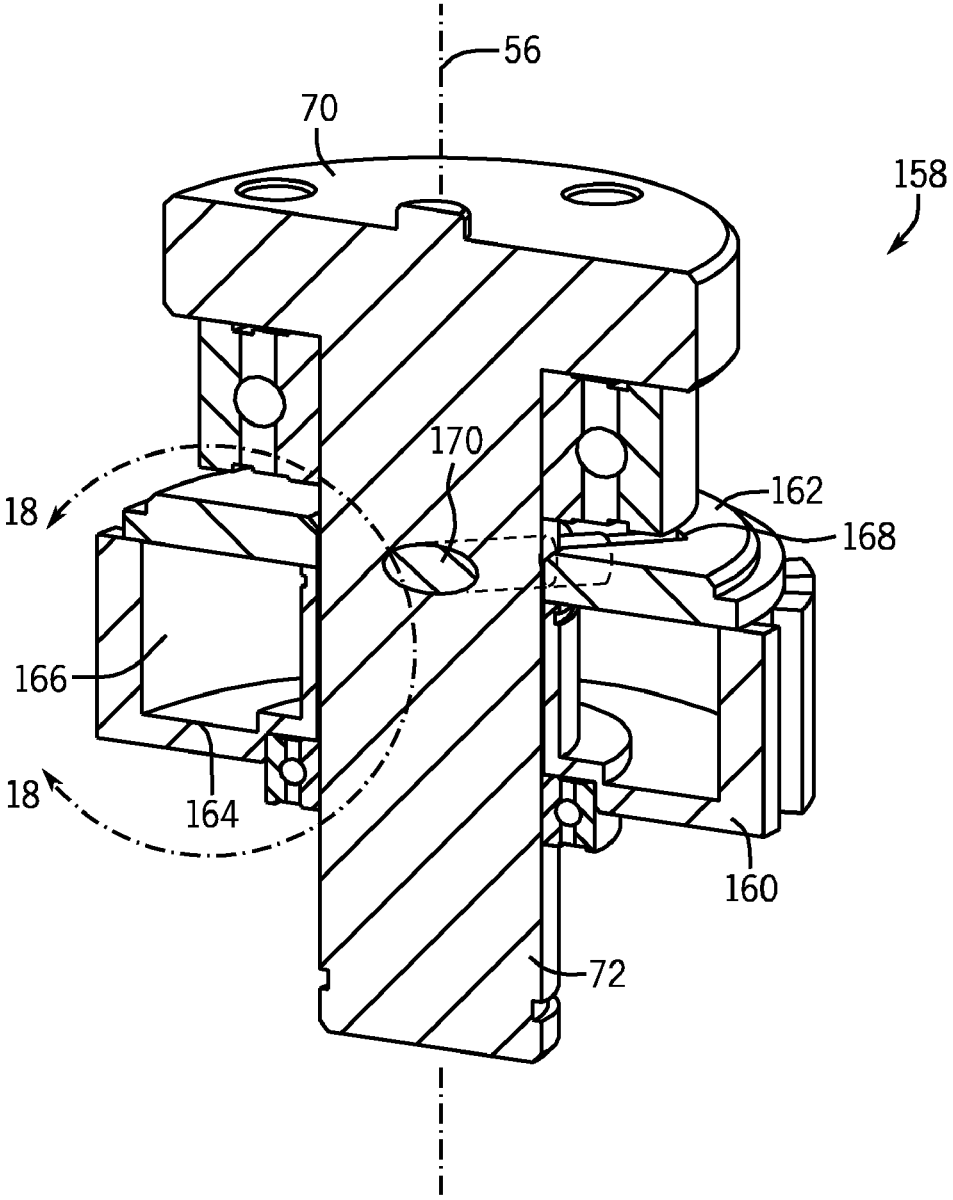
FIG. 17 is a longitudinal cross-sectional view of the first releasable resistance assembly of FIG. 16.
Figure 18A:
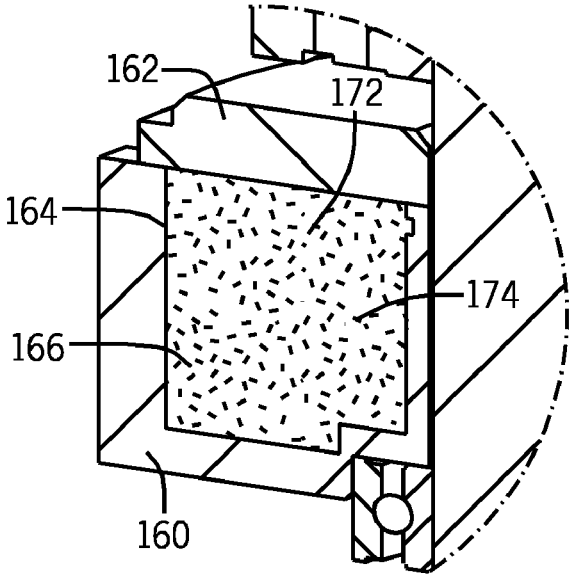
FIGS. 18A and 18B are enlarged sectional views of a portion of the first releasable resistance assembly from circle 18 of FIG. 17.
Figure 18B:
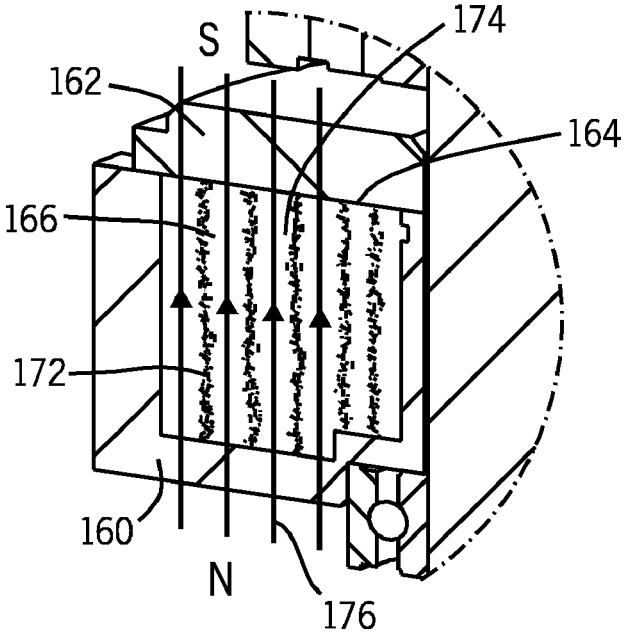

In certain embodiments, the first releasable resistance assembly 58 includes first and second members 60, 62 contacting the high viscosity fluid, with at least one of the first and second members 60, 62 being rotatable about the first axis 56. FIG. 14 is a cross-sectional view of the stringing platform 26, which illustrates the first and second members 60, 62 in the first releasable resistance assembly 58. A cross-sectional view of the first releasable resistance assembly 58 is shown in greater detail in FIG. 15. The first and/or second members 60, 62 may include a plurality of projections, such as spaced-apart concentric rings, contacting the fluid. For example, each of the first and second members 60, 62 may include a plurality of spaced-apart concentric rings with the rings of the first and second members 60, 62 configured to correspond to each other such that portions of the rings of one of the members fit within the spaces between the rings of the other member. In alternative preferred embodiments, the first and second members 60 and 62 can take be formed in other corresponding shapes having different numbers of projections in different orientations.

The first releasable resistance assembly 58 may also include a latch 64 that releasably engages the first member 60 to prevent the first member 60 from rotating about the first axis 56. The latch 64 may be manually operated or remotely operated through a conventional actuation mechanism. In one preferred embodiment, the latch 64 can be used to switch the first resistance assembly 58 between the engaged operating position in which the resistance assembly 58 resists rotation of the turntable 54 about the first axis 56, and a disengaged operating position in which the resistance assembly 58 does not resist rotation of the turntable 54 about the first axis 56. When the latch 64 is positioned to engage the first member 60 and to prevent the member 60 from rotating about the first axis 56, the second member 62 remains free to rotate about the first axis 56. However, with the first member 60 in a locked position, the second member 62 rotates with respect to the first member 60 and the high viscosity fluid positioned between the corresponding projections of the first and second members 60 and 62 provides resistance to rotation of the second member 62 about the first axis 56.

As illustrated in FIG. 13, a second releasable resistance assembly 66, separate from the first releasable resistance assembly 58, may also be coupled to the stringing platform 26. For example, as shown in FIG. 11, the turntable 54 may include a ring 68 centered about the first axis 56, and the second releasable resistance assembly 66 may be configured to releasably engage the ring 68 to prevent rotation of the turntable 54 about the first axis 56. The mechanism of the second releasable resistance assembly 66 may be similar to a bicycle brake, with a lever operated by the user at one end and the opposite end designed to contact the inner surface of the ring 68 when the brake is applied, thus creating sufficient friction to prevent the turntable 54 from rotating. Preferably, the second releasable resistance assembly 66 releasably locks into position by the user. In contrast with the first releasable resistance assembly 58, which merely resists rotation, the second releasable resistance assembly 66 is configured to directly stop the turntable 54 from rotating about the first axis 56, including bringing the turntable 54 to a stop in mid-rotation.

Referring to FIGS. 16-18A&B, an alternative preferred embodiment of a first releasable resistance assembly 158 is shown. The first releasable resistance assembly 158 provides similar functional benefits of the first releasable resistance assembly 58. The first releasable resistance assembly 158 is coupled to the turntable 54 and to the stringing platform 26. The first releasable resistance assembly 158 is configured to be positionable between an engaged operating position in which the first resistance assembly 158 resists or inhibits rotation of the turntable 54 about the first axis 56, and a disengaged operating position in which the resistance assembly 158 does not resist rotation of the turntable 54 about the first axis 56. The first releasable resistance assembly 158 can provide resistance to unintentional rotation of the turntable 54, and in particular, it can negate the effects of gravity when a racquet is in place on the stringing machine 10 and the stringing platform 26 is tilted. The engaged operating position of the first releasable resistance assembly 158 can also be configured to vary the level of resistance that can be used to resist rotation of the turntable 54.

The first releasable resistance assembly 158 is coupled to the turntable 54 (FIG. 11) and the stringing platform 26 (FIG. 11) through a turntable mount 70 having a central column 72 extending about the first axis 56. The first releasable resistance assembly 158 includes first and second members 160 and 162. The first member 160 surrounds the central column 72 and is positioned adjacent to the second member 162. The first member 160 is preferably fixed to the stringing platform 26 and does not rotate about the first axis 56. In an alternative preferred embodiment, an actuation mechanism can be used to selectably lock or unlock the first member thereby either fixing the movement of the first member or enabling the first member to rotate about the first axis 56 and with the central column 72. The second member 162 is preferably configured to rotate about the first axis 56. The second member 162 can define a recess 168 for receiving a drive pin 170. The drive pin 170 is positioned within the recess 168 and causes the second member 162 to rotate about the first axis 56 and along with the central column 72. In alternative preferred embodiments, the other mechanisms for fixing and unfixing the rotational movement of one or both of the first and second members 162 and 162 about the first axis 56 can be employed. The actuation pin can be replaced with some other repositionable assembly, part or parts.

The first and second members 160 and 162 define an annular cavity 164 for holding a magnetorheological fluid 166 ("MR fluid"). The MR fluid 166 includes a percent by volume of small metallic particles 172 within a carrier fluid 174. The metallic particles 168 are preferably iron particles. In alternative preferred embodiments, other metallic particles can be used. The metallic particles 172 preferably take up approximately 20-40 percent by volume of the MR fluid 166. In other preferred embodiments other percent amounts by volume of particles within the MR fluid can be used. The particles 172 can be spherical, ellipsoids, other shapes and combinations thereof. The particles 172 are very small and can be in micrometer scale or in the nanometer scale. In one preferred embodiment, the particles have a size (or diameter) within the range of 3 to 10 microns. In another alternative preferred embodiment, the particles 168 can have a size within the range of 0.1 to 10 μm. In other preferred embodiment, other sizes and size ranges of particles can be used. The carrier fluid 174 is preferably an oil, such as a mineral oil or a synthetic oil. In alternative preferred embodiments, the carrier fluid can be other oils, water, glycol, other fluids or combinations thereof. Additives can also be added to the MR fluid 166 to discourage gravitational settling of the particles 172 and to promote particle suspension within the MR fluid 166.

The MR fluid 166 is a free-flowing liquid generally having a consistency of oil. However, when the MR fluid 166 is subjected to a magnetic field 176, the MR fluid 166 greatly increases its apparent viscosity. The rheology of the fluid changes, virtually instantly, to a fluid with a much greater apparent viscosity. For example, the apparent viscosity of the MR fluid 166 under the magnetic field 176 can change such that the MR fluid 166 has a consistency of peanut butter. The magnetic field 176 is induced by applying a charge to the central column 72, by applying a current around the central column 72 or through other electrical means.

In the absence of the magnetic field 176 (see FIG. 18A), the particles 172 in the MR fluid 166 are generally evenly or randomly dispersed within the fluid, and the fluid flows freely. The free flowing MR fluid 166 allows for free movement of relative parts, such as free movement of the first element 160 relative to the second member 162 when the first member 160 is in a fixed position. Upon the application of the magnetic field 176 (see FIG. 18B), the particles 172 generally align along the flux path generated by the magnetic field 172. The formation of essentially chains of the particles 172 restricts the movement of the fluid within the cavity 164, and the fluid's yield strength and apparent viscosity is greatly increased. The inter-particle attraction or alignment of the particles 172 can be altered by increasing or decreasing the strength of the magnetic field 176 to control the rheological properties of the MR fluid 166, and hence the braking or resistance force of the MR fluid 166. Therefore, the MR fluid changing to a consistency of peanut butter is on example of the varying and available fluid consistencies. In one extreme, the consistency of the fluid can be comparable to a solid. One supplier of MR fluids for use with the present invention is Lord Corporation located at 111 Lord Drive, Cary, N.C. 27511.

In one preferred embodiment the cavity 164 is defined to provide a volume for the MR fluid 166. The distance by which the MR fluid 166 separates the first and second members 160 and 162 can affect the change in viscosity of the MR fluid 166. In one preferred embodiment, the distance by which the MR fluid 166 separates the first and second members 160 and 162 is within the range of 0.25 to 5 mm. In another preferred embodiment, the distance is within the range of 0.5 to 2 mm. In other alternative preferred embodiments, other distances or ranges of distances can also be used. In yet another alternative preferred embodiment, the first releasable resistance assembly can be configured such that the distance separating the first and second members can be selectably changed to alter the resistance against rotation of the turntable about the first axis that is applied by the MR fluid when the magnetic field is applied.

When the first releasable resistance assembly 158 is in an engaged operating position, the magnetic field 176 can be applied across the first and second members 160 and 162. Under the magnetic field 176, the apparent viscosity of the RH fluid 166 will significantly increase resisting and inhibiting rotation of the turntable 54 about the first axis 56. In one preferred embodiment, the application of the magnetic field 176 can be a simple on/off selection made at the stringing platform 26. In another alternative preferred embodiment, the stringing platform 26 can be configured with a controller for varying the strength of the magnetic field 176 and therefore the apparent viscosity of the MR fluid to obtain a resistance level desired by the user.

Figure 19:
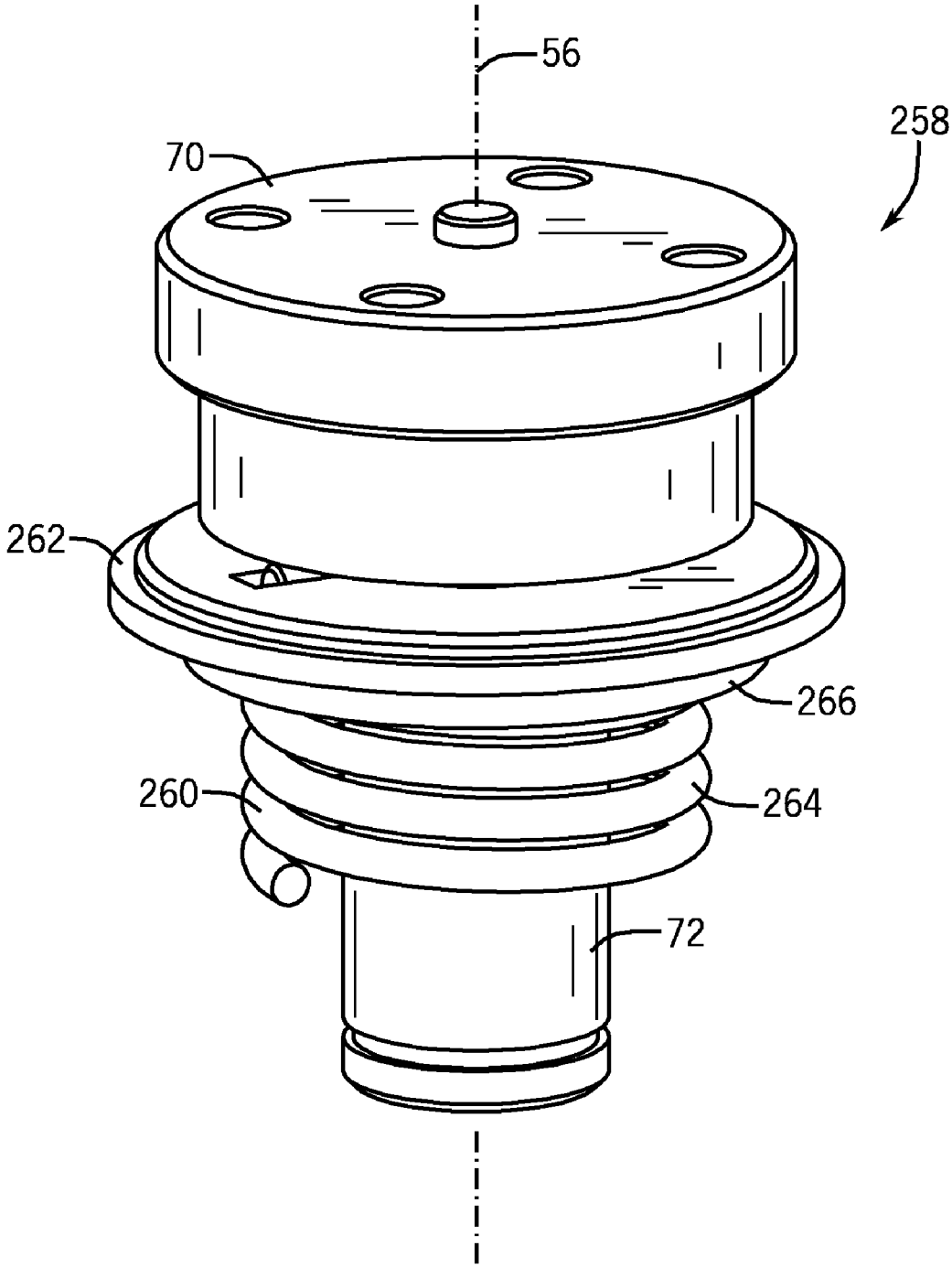
FIG. 19 is a front perspective view of a first releasable resistance assembly in accordance with another alternative preferred embodiment of the present invention.
Figure 20:
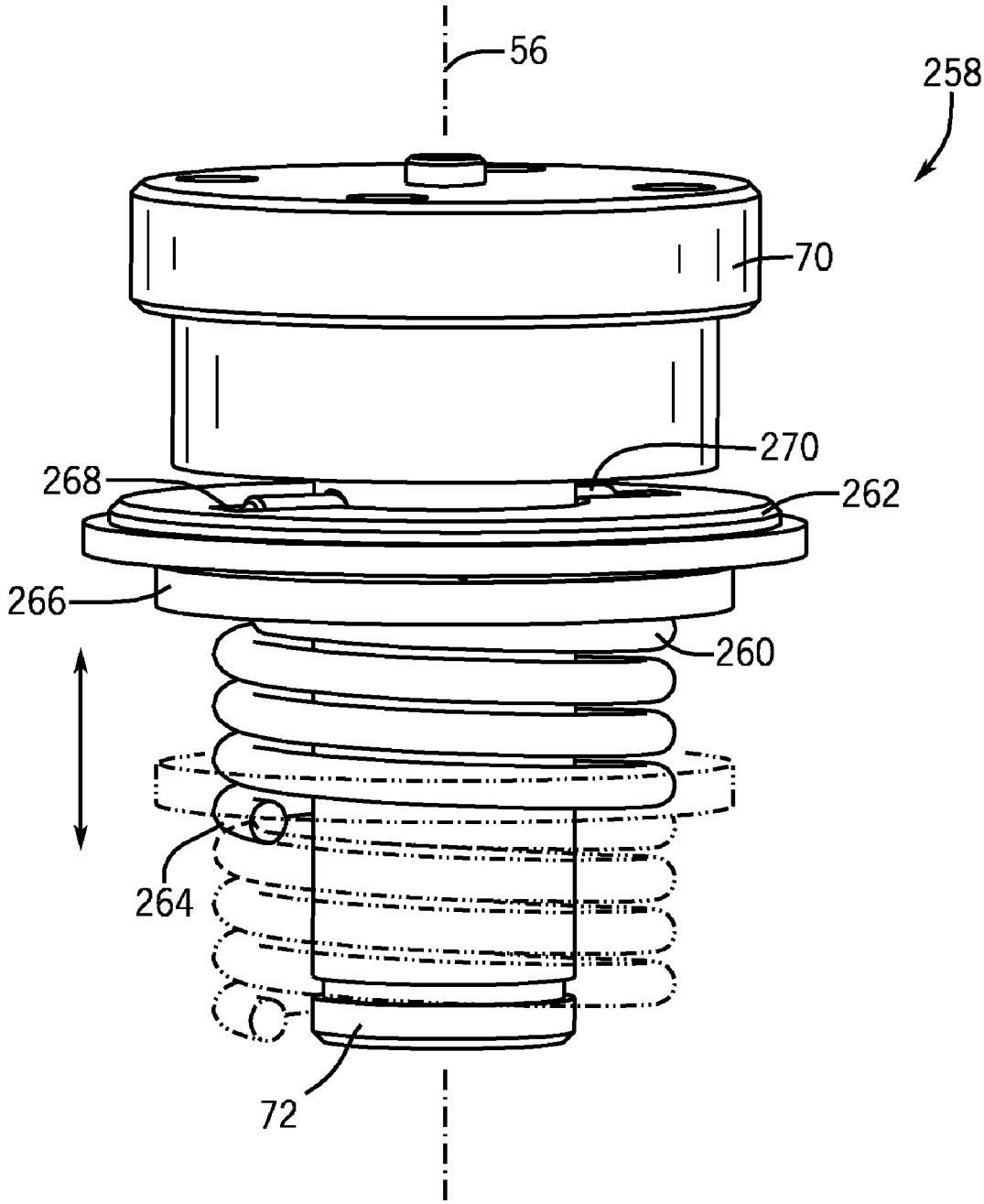
FIG. 20 is front view of the first releasable resistance assembly of FIG. 19 showing the movement of a first member about the first axis.

Referring to FIGS. 19 and 20, an alternative preferred embodiment of a first releasable resistance assembly 258 is shown. The first releasable resistance assembly 258 provides similar functional benefits of the first releasable resistance assembly 58. The first releasable resistance assembly 258 is coupled to the turntable 54. The first releasable resistance assembly 258 is configured to be positionable between an engaged operating position in which the first resistance assembly 258 resists or inhibits rotation of the turntable 54 about the first axis 56, and a disengaged operating position in which the resistance assembly 258 does not resist rotation of the turntable 54 about the first axis 56. The first releasable resistance assembly 258 can provide resistance to unintentional rotation of the turntable 54, and in particular, it can negate the effects of gravity when a racquet is in place on the stringing machine 10 and the stringing platform 26 is tilted.

The first releasable resistance assembly 258 is coupled to the turntable 54 (FIG. 11) and the stringing platform 26 (FIG. 11) through a turntable mount 70 having a central column 72 extending about the first axis 56. The first releasable resistance assembly 258 includes first and second members 260 and 262. The first member 260 surrounds the central column 72 and preferably includes a biasing member 264 and an engaging element 266. The biasing member 264 is preferably a coil spring, but can also be configured as other forms of springs or biasing devices. One portion of the biasing member 264 is preferably coupled to the stringing platform 26 to fix a first portion of the biasing member 264 and prevent the first portion from rotating about the first axis 56, and an upward portion of the biasing member 264 is coupled to the engaging element 266. The engaging element 266 is a disc like member configured for releasably and selectably engaging the second member 262.

The second member 262 is preferably configured to rotate about the first axis 56. The second member 262, like the second member 162, can define a recess 268 for receiving a drive pin 270. The drive pin 270 is positioned within the recess 168 and causes the second member 262 to rotate about the first axis 56 and along with the central column 72.

The first member 260 is preferably configured to be positionable and between a first operating position wherein the first member 260 operably engages the second member 262 to resist rotation of the second member 262 about the first axis 56, and a second operating position, wherein the first member 260 is decoupled from the second member 262 such that the second member 262 is free to rotate about the first axis 56 with the turntable 54 and the central column 72. Referring to FIG. 20, the first member 260 can be moved along the first axis 56 to selectably engage or disengage the second member 262. When engaged, the size, strength and/or spring constant of the biasing member 264 can be used, selected or adjusted to obtain the desired amount of resistance to rotation of the second member 262 (and therefore the turntable 54) about the first axis 56. The first releasable resistance assembly 258 is configured to resist or inhibit undesired rotation of a racquet placed onto the turntable and the stringing platform about the first axis 56 due to gravitational forces when the stringing platform is tilted with respect to a horizontal support surface. The user can selectably engage and disengage the first releasable resistance assembly 258 while stringing thereby engaging the first and second members 260 and 262 when the user wants the racquet to remain relatively still and in position, and disengage the first and second members 260 and 262 when the user desires to freely reposition and rotate the racquet about the first axis 56.

Figure 21:
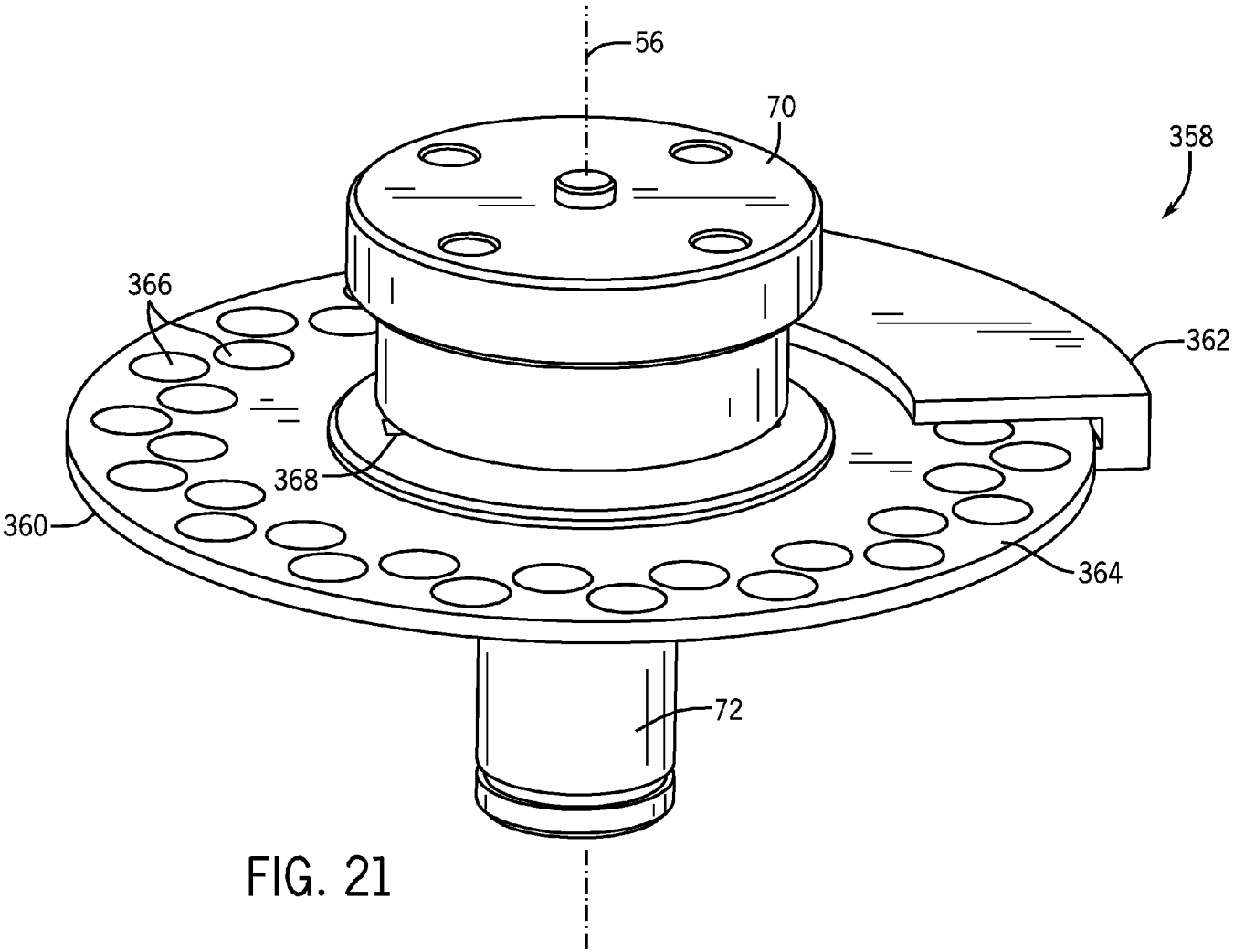
FIG. 21 is a front, upper perspective view of a first releasable resistance assembly in accordance with another alternative preferred embodiment of the present invention.
Figure 22:
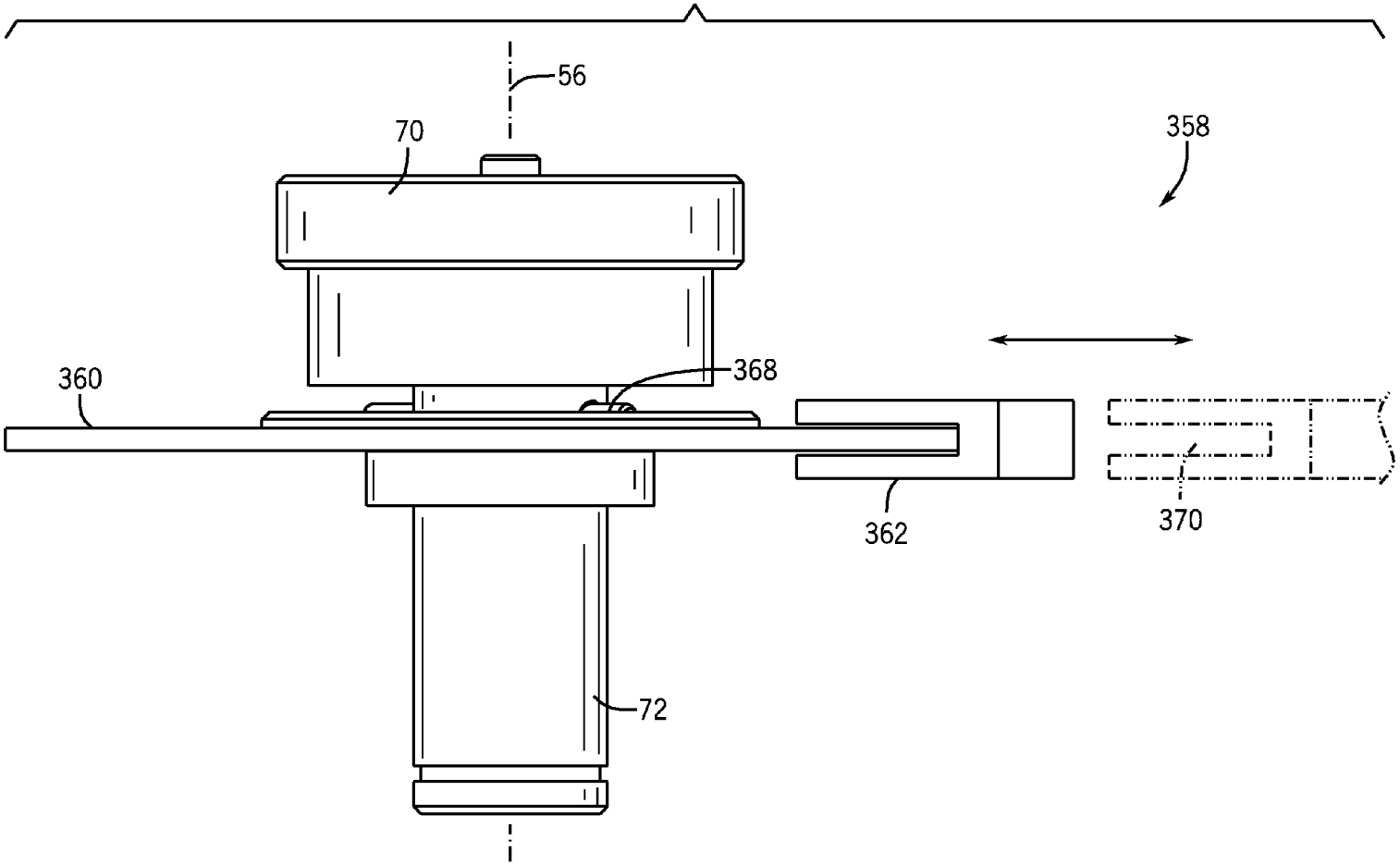
FIG. 22 is a front view of a first releasable resistance assembly of FIG. 21 illustrating the positioning of a caliper with respect to a disc.

Referring to FIGS. 21 and 22, an alternative preferred embodiment of a first releasable resistance assembly 358 is shown. The first releasable resistance assembly 358 provides similar functional benefits of the first releasable resistance assembly 58. The first releasable resistance assembly 358 is coupled to the turntable 54 and to the stringing platform 26. The first releasable resistance assembly 358 is configured to be positionable between an engaged operating position in which the first resistance assembly 358 resists or inhibits rotation of the turntable 54 (FIG. 11) about the first axis 56, and a disengaged operating position in which the resistance assembly 358 does not resist rotation of the turntable 54 about the first axis 56. The first releasable resistance assembly 358 can provide resistance to unintentional rotation of the turntable 54, and in particular, it can negate the effects of gravity when a racquet is in place on the stringing machine 10 and the stringing platform 26 is tilted.

The first releasable resistance assembly 358 is coupled to the turntable 54 (FIG. 11) and the stringing platform 26 (FIG. 11) through a turntable mount 70 having a central column 72 extending about the first axis 56. The first releasable resistance assembly 358 includes a first disc 360 and a movable caliper 362. The first disc 360 is a generally planar, circular plate having a plurality of recesses 364 for receiving a plurality of metallic elements 366. The first disc 360 is fixed to the central column 72 and rotates with the central column 72 about the first axis 56. In one preferred embodiment, a pin 368 is used to connect the central column 72 to the disc 360.

The caliper 362 includes a curved slot 370 for selectably receiving a portion of the disc 360. The caliper 362 selectably straddles a portion of the disc 360. The caliper 362 is formed at least in part of a metallic material. One or more of the caliper and the metallic elements 366 can be configured as magnets. The caliper 362 is operably coupled to the stringing platform 26.

When the caliper 362 is positioned over the disc 360, the magnetic field between the metallic elements 366 and the caliper 362 brakes, resists or inhibits the rotation of the disc 360 about the first axis 56. The amount of braking force or resistance applied to the disc 360 can be selected by varying the magnetic field formed by the metallic elements 366 and the caliper 362. This can be accomplished by varying the size of the metallic elements 366 and the metallic material of the caliper 362 or by varying the distance between the disc 360 and the caliper 362. Referring to FIG. 22, the caliper 362 can be configured to be positionable between an engaged position and a disengaged position. In the engaged position, the caliper 362 straddles a portion of the disc 360 such that the portion of the disc 360 extends into the curved slot 370 of the caliper 362. The caliper 362 extends over one or more of the metallic elements 366. In the engaged position, a magnetic field is formed that resists or inhibits the rotation of the disc 360 and therefore the central column 72 about the first axis 56. In the disengaged position, the caliper 362 is spaced apart from the disc 360 such that the caliper no longer extends over a portion of the disc 360. No magnetic braking force is applied to the disc when the caliper 362 is in the disengaged position thereby enabling the disc 360 to be freely rotated by the user.

In alternative preferred embodiments, the disc 360 can include one or more projections outwardly extending from the central column 72. The disc may have a circular shape or other geometric shapes including irregular shapes. The metallic elements 366 can be circular magnets or magnets of other shapes. The metallic elements 366 can be formed of magnetized or non-magnetized metallic material. The user therefore can selectably engage and disengage the first releasable resistance assembly 358. When engaged, the caliper 362 will straddle the disc 360 and the magnetic field formed by the caliper 362 and the metallic elements 366 will resist or inhibit rotation of the central column 72 about the first axis 56 and when disengage, the caliper 362 will be positioned away from the disc 360 reducing or eliminating the magnetic field and enabling the disc 360 and the central column to be freely rotated about the first axis 56.

Figure 23:
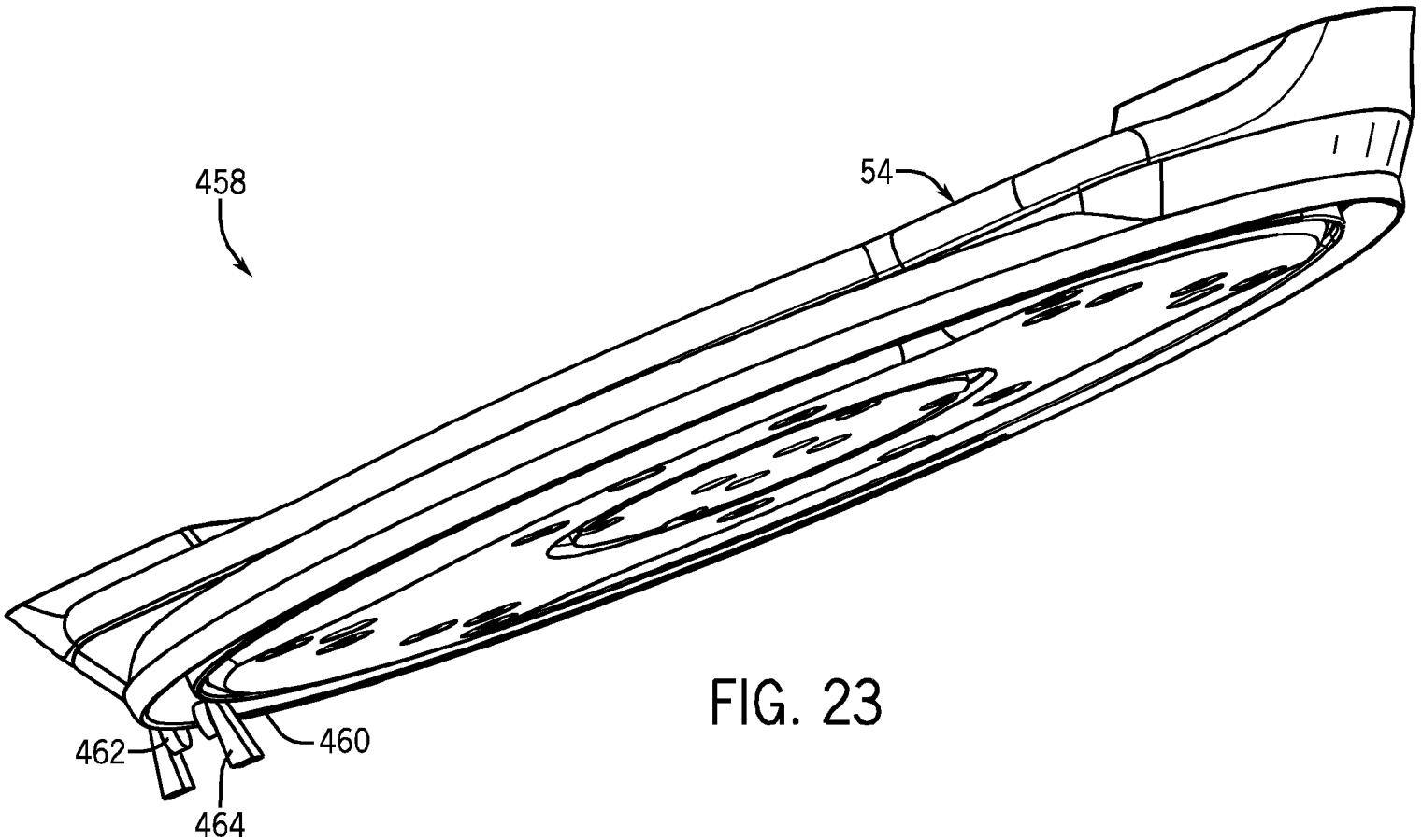
FIG. 23 is a front, lower perspective view of a first releasable resistance assembly in accordance with another alternative preferred embodiment of the present invention.
Figure 24:
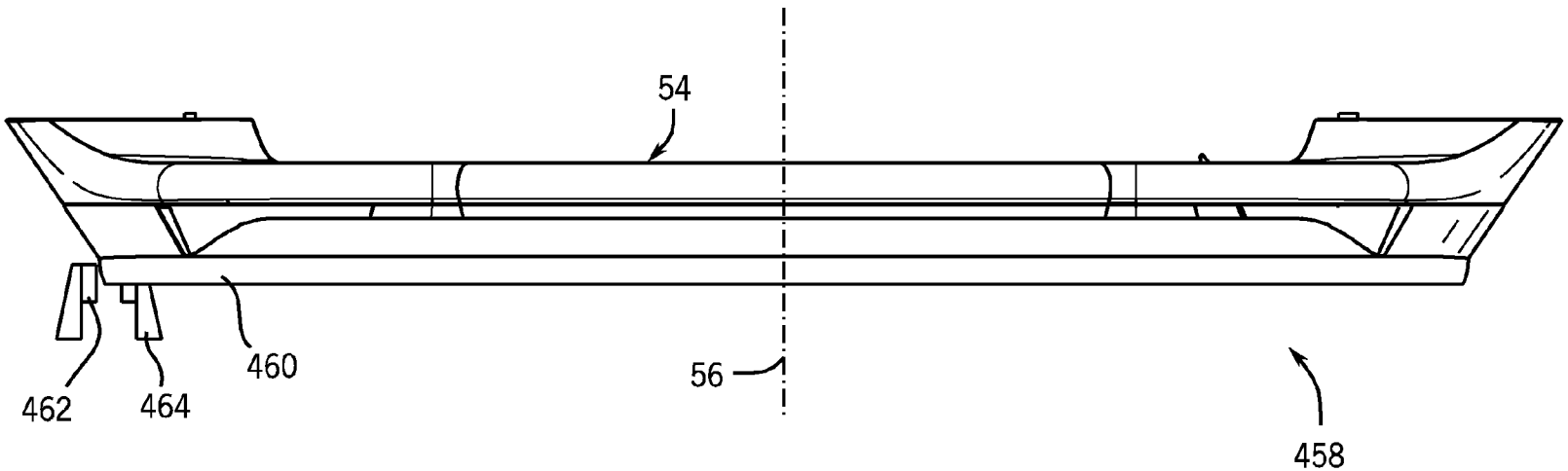
FIG. 24 is a front view of the first releasable resistance assembly of FIG. 23.

Referring to FIGS. 23 and 24, an alternative preferred embodiment of a first releasable resistance assembly 458 is shown. The first releasable resistance assembly 458 provides similar functional benefits of the first releasable resistance assembly 58. The first releasable resistance assembly 358 is coupled to the turntable 54 and to the stringing platform 26. The first releasable resistance assembly 358 is configured to be positionable between an engaged operating position in which the first resistance assembly 458 resists or inhibits rotation of the turntable 54 about the first axis 56, and a disengaged operating position in which the resistance assembly 458 does not resist rotation of the turntable 54 about the first axis 56. The first releasable resistance assembly 458 can provide resistance to unintentional rotation of the turntable 54, and in particular, it can negate the effects of gravity when a racquet is in place on the stringing machine 10 and the stringing platform 26 is tilted.

The first releasable resistance assembly 458 is releasably connected to a ring 460 formed on the underside of the turntable 54. The first releaseable resistance assembly 458 includes a pair of brake pads 462 positioned onto a pair of brake arms 464. The brake arms 464 are coupled to the stringing platform 26 and are not configured to rotate about the first axis 56. The brake pads 462 are positioned on the underside of the turntable 54 adjacent to the inner and outer surfaces of the ring 460. As the turntable 54 rotates about the first axis 56, the ring 460 extends through the space existing between the brake pads 462. The brake arms 464 and the brake pads 462 are selectably positionable, such that when actuated the brake arms 464 and the brake pads 462 are drawn closer to each other such that the brake pads 462 contact the inner and/or outer surfaces of the ring 460 to apply a braking force or resistance inhibiting the rotation of the turntable 54 relative to the first axis 56.

The user therefore can selectably engage and disengage the first releasable resistance assembly 458. When engaged, the brake pads 462 will draw together and contact the ring 460 of the turntable 54 and will resist or inhibit rotation of the turntable 54 about the first axis 56 and when disengage, the brake pads 462 will be spaced apart and away from the ring 460 enabling the disc 360 and the central column to be freely rotated about the first axis 56. The first releasable resistance assembly 458 can be configured as an on/off assembly or as an assembly that can produce a varied amount of resistance countering the rotation of the turntable 54 as desired by the user through the use of a controller coupled to the stringing platform.

The first releasable resistance assemblies 58, 158, 258, 358 and 458 when in an engaged operating mode can each apply sufficient resistance to resist the rotation of the turntable about the first axis such that when a racquet is mounted to the stringing platform and the stringing platform and/or the stringing plane of the racquet is angled with respect to the generally horizontal support surface, gravity does not cause the racquet to rotate about the first axis. This feature is particularly useful when the handle of the racquet is positioned at a height that is equal to or greater than the height of the string bed of the racquet. In other words, when the stringing plane is tilted with respect to the generally horizontal support surface, the first releasable resistance assembly 58, 158, 258, 358 or 458 prevents rotation of the racquet about the first axis due to the force of gravity or gravitational forces acting on the racquet. However, the resistance level applied to resist the rotation of the turntable about the first axis can be selected such that it does not prevent the user of the stringing machine 20 from manually contacting and moving the racquet about the first axis 56.

Each embodiment of the first releasable resistance assembly 156, 256, 356 and 456 is configured to resist a torque about the first axis within the range of 0.1 to 36 in-lbf. In one set of preferred embodiments, each embodiment of the first releasable resistance assembly 156, 256, 356 and 456 is configured to resist a torque about the first axis within the range of 0.1 to 12 in-lbf. In other preferred embodiments, the resistance force applied by the first releasable resistance assembly 156, 256, 356 and 456 is 3 lbs or less.

Any one or more of the stringing machine embodiments described herein may be applied to machines for stringing tennis racquets, racquetball racquets, squash racquets, badminton racquets, and any other strung racquet. In particular, the stringing machine 20 may be used to string racquets for use in an organized professional league and/or in competitive play. Furthermore, the stringing machine 20 may be configured to string racquets in a manner that meets ITF Rules of Tennis requirements for racquet strings. Regardless of the type of racquet, compatibility of the stringing machine 20 with the user is greatly improved by using any of the stringing machine enhancements in this invention.

While the preferred embodiments of the invention have been illustrated and described, it will be appreciated that various changes can be made therein without departing from the spirit and scope of the invention. For example, while the embodiments described herein are illustrated in a stringing machine for stringing a tennis racquet, the principles of the present invention could also be used for stringing machines for stringing practically any other type of racquet. Accordingly, it will be intended to include all such alternatives, modifications and variations set forth within the spirit and scope of the appended claims.

What is claimed is:

1. A stringing machine, comprising:

a base;

an adjustable stringing platform coupled to the base, the stringing platform including a turntable rotatable about a first axis, and a first releasable resistance assembly coupled to the turntable, the first releasable resistance assembly being selectable between an engaged operating mode in which the releasable resistance assembly resists rotation of the turntable about the first axis, and a disengaged operating mode in which the releasable resistance assembly does not resist rotation of the turntable about the first axis, the releasable resistance assembly including a magnetorheological fluid for resisting rotation of the turntable about the first axis when in the engaged operating mode.

2. The stringing machine of claim 1, wherein the base is configured for supporting the stringing machine on a generally horizontal surface, wherein the stringing platform supports the racquet about a stringing plane, and wherein the stringing plane is angled with respect to the generally horizontal surface.

3. The stringing machine of claim 1, wherein the magnetorheological fluid includes a carrier fluid and a quantity of magnetic particles within the carrier fluid.

4. The stringing machine of claim 3, wherein the quantity of magnetic particles within the carrier fluid is within 20 to 40 percent by volume of the magnetorheological fluid.

5. The stringing machine of claim 3, wherein the magnetic particles are iron particles.

6. The stringing machine of claim 3, wherein the size of the particles falls within one of a micrometer scale and a nanometer scale.

7. The stringing machine of claim 3, wherein the carrier fluid is selected from the group consisting of a mineral oil, a synthetic oil, water, glycol, other oils, other fluids and combinations thereof.

8. The stringing machine of claim 1, wherein a magnetic field is induced across the first releasable resistance assembly.

9. The stringing machine of claim 8, wherein in the magnetic field is induced across the first releasable resistance assembly when the first releasable resistance assembly is in the engaged operating mode, and the magnetic field is removed from the first releasable resistance assembly when the first releasable resistance assembly is in the disengaged operating mode.

10. The stringing machine of claim 8, wherein in the magnetic field is the varied to vary the resistance that is applied by the first releasable resistance assembly to resist rotation of the turntable about the first axis.

11. A racquet stringing machine configured to support a racquet, the stringing machine comprising:

a base;

an adjustable stringing platform coupled to the base, the stringing platform including a turntable rotatable about a first axis, and a first releasable resistance assembly coupled to the turntable, the turntable including a ring centered about the first axis, the first releasable resistance assembly being selectable between an engaged operating mode in which the releasable resistance assembly applies a resistance force of 3 lbs or less against the rotation of the turntable about the first axis, and a disengaged operating mode in which the releasable resistance assembly does not resist rotation of the turntable about the first axis, the first releasable resistance assembly including a pair of brake arms configured to selectably engage the ring for resisting rotation of the turntable about the first axis when in the engaged operating mode.

12. The stringing machine of claim 11, wherein the base is configured for supporting the stringing machine on a generally horizontal surface, wherein the stringing platform supports the racquet about a stringing plane, and wherein the stringing plane is angled with respect to the generally horizontal surface.

13. The stringing machine of claim 12, wherein when in the engaged operating mode, the first releasable resistance assembly prevents the rotation of the racquet about the first axis due to force of gravity acting on the racquet.

14. The stringing machine of claim 13, wherein when the releasable resistance assembly is in the engaged operating mode, a user can contact the racquet and rotate the racquet about the first axis.

15. The stringing machine of claim 11, wherein the pair of brake arms are coupled to the stringing platform and include a corresponding pair of brake pads, and wherein the brake pads engage the ring of the turntable.

16. The stringing machine of claim 11, further comprising a second releasable resistance assembly coupled to the stringing platform and the turntable, and wherein the second releasable resistance assembly when activated locks the turntable preventing the turntable from rotating about the first axis.

17. A racquet stringing machine configured to support a racquet, the stringing machine comprising:

a base;

a stringing platform coupled to the base, the stringing platform including a turntable rotatable about a first axis, a first releasable resistance assembly coupled to the turntable, the first releasable resistance assembly being selectable between an engaged operating mode in which the releasable resistance assembly applies a resistance force of 3 lbs or less against the rotation of the turntable about the first axis, and a disengaged operating mode in which the releasable resistance assembly does not resist rotation of the turntable about the first axis, and a second releasable resistance assembly coupled to the stringing platform and the turntable, and wherein the second releasable resistance assembly when activated locks the turntable preventing the turntable from rotating about the first axis.

18. The stringing machine of claim 17, wherein the first releasable resistance assembly includes a disc coupled to the turntable and outwardly extending from the first axis and a caliper coupled to the stringing platform, wherein the disc and the caliper include at least one magnet for applying the resistance force against the rotation of the turntable about the first axis.

19. The stringing machine of claim 18, wherein the disc includes a plurality of elements, wherein the elements are magnets, metallic elements or a combination of magnets and metallic elements, and wherein the caliper includes a corresponding magnet or metallic element such that the caliper when positioned adjacent the one or more of the elements creates a magnetic force that is the resistance force.

20. The stringing machine of claim 19, wherein when the first releasable resistance assembly is in the engaged operating mode, the caliper is positioned adjacent the disc, and wherein when the first releasable resistance assembly is in the disengaged operating mode, the caliper is positioned away from the disc.

21. The stringing machine of claim 17, wherein the first releasable resistance assembly includes a biasing member.

22. The stringing machine of claim 21, wherein the biasing member is a coil spring.

* * * * *